US012747089B2

(12) United States Patent
Baker et al.

(10) Patent No.: US 12,747,089 B2
(45) Date of Patent: Sep. 29, 2026

(54) PRESSURIZED CONTAINER INCLUDING FLOWABLE PRODUCTS AND NON-SOLUBLE PROPELLANT

(71) Applicant: Clayton Corporation, Fenton, MO (US)

(72) Inventors: Mark Baker, Catawissa, MO (US); James David Wilson, II, Collinsville, IL (US)

(73) Assignee: Clayton Corporation, Fenton, MO (US)

( * ) Notice: Subject to any disclaimer, the term of this patent is extended or adjusted under 35 U.S.C. 154(b) by 148 days.

(21) Appl. No.: 18/908,595

(22) Filed: Oct. 7, 2024

(65) Prior Publication Data

US 2025/0100781 A1 Mar. 27, 2025

Related U.S. Application Data

(63) Continuation of application No. 18/328,944, filed on Jun. 5, 2023, now Pat. No. 12,110,168, which is a continuation of application No. 17/588,575, filed on Jan. 31, 2022, now Pat. No. 11,691,805.

(60) Provisional application No. 63/264,008, filed on Nov. 12, 2021, provisional application No. 63/143,371, filed on Jan. 29, 2021.

(51) Int. Cl.
*B65D 83/28* (2025.01)
*B65D 83/46* (2006.01)

(52) U.S. Cl.
CPC ..... *B65D 83/28* (2013.01); *B65D 83/46* (2013.01)

(58) Field of Classification Search
CPC ..... B65D 83/28; B65D 83/46; B65D 83/141; B65D 83/32; B65D 83/58; B01F 25/422; B01F 25/4413; B01F 25/45241; B01F 25/45242; B01F 31/20; B01F 35/32021; B05B 7/0043
See application file for complete search history.

(56) References Cited

U.S. PATENT DOCUMENTS 2,487,434 A 11/1949 Geiss et al.
2,691,466 A 10/1954 Efford et al.
3,954,208 A * 5/1976 Brill ..... B65D 83/46 251/249
3,970,219 A 7/1976 Spitzer et al.
4,993,599 A 2/1991 Gruenewald
(Continued)

FOREIGN PATENT DOCUMENTS

GB 1242613 A 8/1971
WO WO1994021384 A1 9/1994
(Continued)

OTHER PUBLICATIONS

International Search Report and Written Opinion for Application No. PCT/US2022/014568, Apr. 15, 2022, 14 pages.
(Continued)

*Primary Examiner* — Donnell A Long
(74) *Attorney, Agent, or Firm* — Stinson LLP

(57) ABSTRACT

A pressurized container assembly includes a pressurized container, a valve, and a shearing chamber. A flowable product and propellant are also provided within the container. The propellant is substantially non-soluble in the flowable product. Methods of producing a foamed flowable product using shearing chambers are also disclosed.

16 Claims, 22 Drawing Sheets

(56) References Cited

U.S. PATENT DOCUMENTS

| | | | | |
|---|---|---|---|---|
| 5,085,371 | A | 2/1992 | Paige | |
| 5,255,851 | A | 10/1993 | Tobler | |
| 5,725,155 | A | 3/1998 | Grunenberg et al. | |
| 6,488,974 | B1 * | 12/2002 | Kuehner | B65D 83/20 426/570 |
| 6,607,106 | B2 | 8/2003 | Henry et al. | |
| 9,296,549 | B2 | 3/2016 | Ghavami-Nasr et al. | |
| 11,597,585 | B2 * | 3/2023 | Adams | B65D 83/46 |
| 11,691,805 | B2 | 7/2023 | Baker et al. | |
| 12,110,168 | B2 | 10/2024 | Baker et al. | |
| 2003/0006252 | A1 | 1/2003 | Henry et al. | |
| 2003/0082243 | A1 | 5/2003 | Harman et al. | |
| 2010/0062096 | A1 * | 3/2010 | Clauwaert | B65D 83/145 222/402.1 |
| 2010/0303971 | A1 * | 12/2010 | Melms, Jr. | A23C 11/08 222/129 |
| 2015/0360853 | A1 | 12/2015 | Nicmanis | |
| 2020/0023323 | A1 | 1/2020 | Nicmanis et al. | |
| 2020/0260914 | A1 | 8/2020 | Lindsey et al. | |

FOREIGN PATENT DOCUMENTS

| | | | |
|---|---|---|---|
| WO | WO2018158560 | A1 | 9/2018 |
| WO | WO2022165337 | A1 | 8/2022 |

OTHER PUBLICATIONS

Extended European Search Report for European Application No. 22746802.2, Jun. 11, 2024, 10 pages, Munich, Germany.

* cited by examiner

PRESSURIZED CONTAINER INCLUDING FLOWABLE PRODUCTS AND NON-SOLUBLE PROPELLANT

STATEMENT OF RELATED CASES

This application is a continuation of U.S. application Ser. No. 18/328,944, filed Jun. 5, 2023, which is a continuation of U.S. application Ser. No. 17/588,575, filed Jan. 31, 2022, issued as U.S. Pat. No. 11,691,805 on Jul. 4, 2023, which claims the benefit of U.S. Provisional Application No. 63/264,008, filed Nov. 12, 2021 and U.S. Provisional Application No. 63/143,371, filed Jan. 29, 2021, the entire contents of which are incorporated herein by reference.

FIELD OF THE DISCLOSURE

The present disclosure relates to pressurized container assemblies using non-soluble propellants. The pressurized container assemblies can include, in some variations, a shearing chamber to mechanically agitate a flowable product. Methods of producing a foamed flowable product using shearing chambers are also disclosed.

BACKGROUND OF THE DISCLOSURE

Pressurized containers (e.g., aerosol containers) which dispense flowable products have found wide application, from dispensing insulating urethane foams to whipped cream and other flowable products. The flowable products are often packaged in aerosol cans with a pressurizing agent, which acts as a propellant for dispensing a liquid product. These aerosol cans include a dispensing valve that may be employed in dispensing a liquid as a foam product. Such valves may be intermittently operated to dispense small amounts of the product as needed.

In the case of flowable products containing fat, nitrous oxide is used as the propellant. Nitrous oxide is a fat-soluble gas and therefore substantially dissolves in fatty products, e.g., cream. When the valve of the pressurized container is opened, the fatty product (e.g., cream) is forced from the nozzle under high pressure. Once this pressure is released from the product, the dissolved nitrous oxide expands into bubbles, transforming the cream to its whipped form outside the can.

In the case of other flowable products—such as shaving cream, hair mousse, and other personal care products—butane or propane, for example, is used as the propellant and a surfactant. Once released from the can, the butane or propane expand within the flowable product creating a foamed product.

In general, in these flowable products, whether flowable food products or flowable personal care products or other products, the propellant in the aerosol may produce the foaming of the product as it exits the can. Moreover, in other conventional products, such as polyurethane foam, the foaming action may be produced by a chemical reaction between two or more chemicals.

BRIEF DESCRIPTION OF THE DRAWINGS

Corresponding reference characters indicate corresponding parts throughout the drawings.

DETAILED DESCRIPTION OF THE DISCLOSURE

Figure 1:
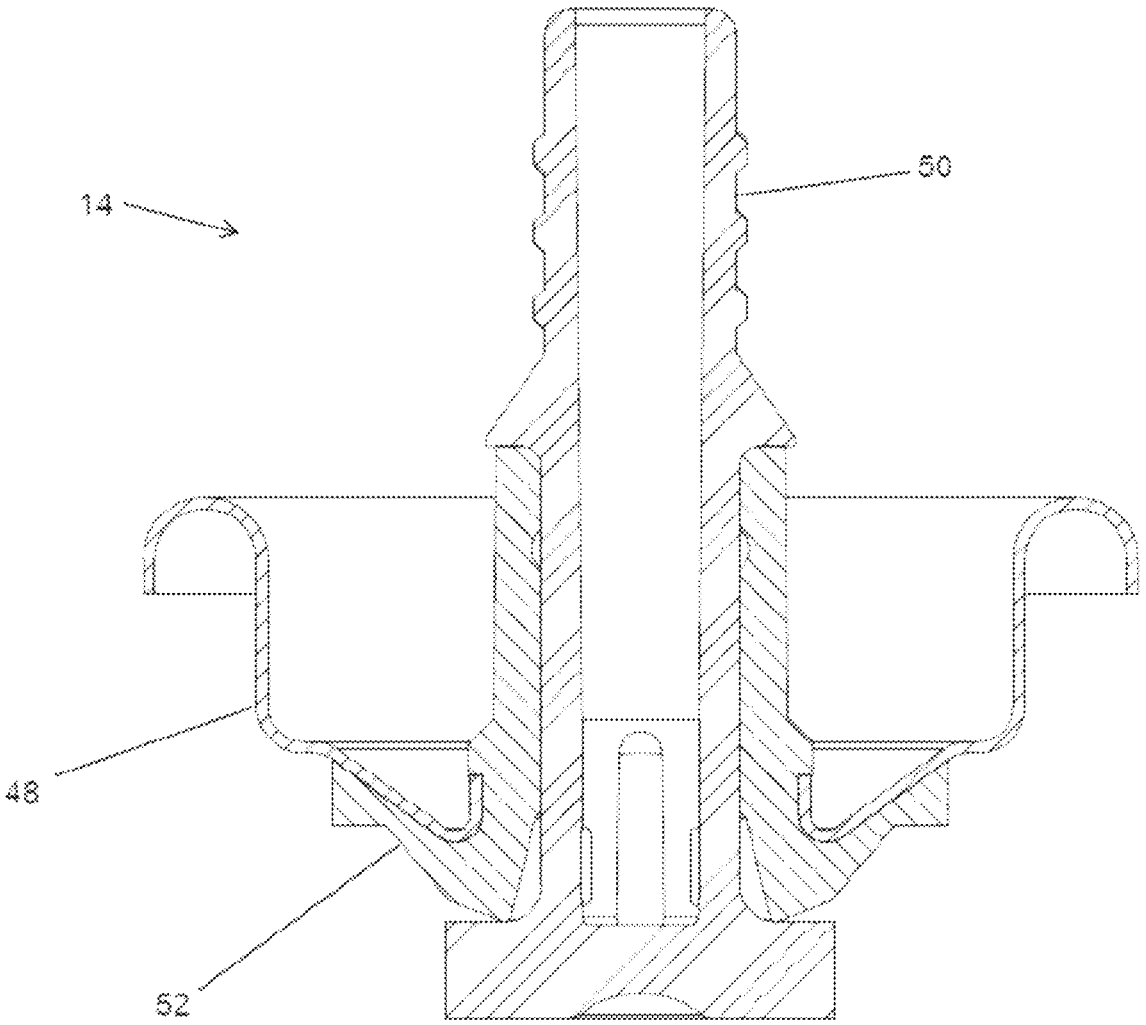
FIG. 1 is a cross section of an embodiment of the valve.

In one embodiment, the present disclosure is directed to a pressurized container suited to foam a flowable product with the use of a propellant, wherein the propellant is substantially non-soluble in the flowable product. Because the non-soluble propellant will not dissolve in the flowable product to produce bubbles upon its release from a high pressure container, essentially foaming the flowable product, a shearing chamber is used to produce bubbles to foam the flowable product.

As a non-limiting example, heavy whipping cream has the properties of a non-Newtonian viscoelastic fluid. In order for whipping cream to transition from a liquid state to a semi-solid/plastic state (i.e., whipped cream), energy in the form of shear needs to be applied to the cream. In traditional aerosol packing, this shear is induced in the cream by dissolved nitrous oxide boiling out of the cream. As the nitrous oxide molecules exit the cream, microscopic turbulent flow is formed between the water and triglyceride molecules. The microscopic turbulent flow forces plastic deformation of the cream. However, the amount of energy that can be added to the cream through boiling off of the nitrous oxide is limited by the maximum pressure of the aerosol can and Henry's law. Henry's law dictates that only a finite amount of nitrous oxide can be dissolved into a medium at a given volume and pressure. Because of this limitation, nitrous-based whipped creams only partially plastically deform, leading to a phenomenon known as slump, where the cream only stays in its semi-solid form for a limited amount of time after release from the aerosol container before it collapses back to a liquid state. Other food grade propellants capable of dissolving into whipping cream are either exceedingly expensive or have an undesirable taste.

In one example, the shearing chamber of the present disclosure introduces shear in excess of the limitations of Henry's law to foam the flowable product. In one embodiment, the shearing chamber uses a boundary layer effect to efficiently induce shear. Other ways of shearing without a boundary layer may be used. In general, the shearing chamber includes tightly-spaced parallel plates, which may be flat, circular, arcuate, or other shapes. In one example, as described herein, this geometry can be converted into two tightly-spaced cylinders nested inside one another to maximize available surface area that the opening in an aerosol container will allow. In another example, the parallel plates may be stacked on top of one another. Other designs of the shearing chamber that are configured to produce boundary layer shearing are possible and may be included in the scope of the present disclosure. The shearing chamber including the boundary layer also efficiently imparts energy into the flowable fatty food product in excess of Henry's law while allowing a non-soluble gas, such as nitrogen, to be used as the primary propellant. This combination of shear device coupled with a nitrogen propellant solves both the problems of slump and use of narcotic propellants, such as nitrous oxide.

When a fatty product is mechanically agitated, e.g., through whisking, air bubbles begin to be incorporated into the product. Continuous agitation removes the outer membrane of the fat particles within the fatty product. The removal of this membrane allows the fat particles to begin to aggregate, forming protective bubbles around the air pockets initially incorporated, and eventually, fat-stabilized air bubbles. It is for this reason that the flowable products of the present disclosure contain a fat content of at least 10 wt. % based on the total weight of the flowable product, for example, at least 15 wt. %, at least 20 wt. %, at least 25 wt. %, at least 30 wt. %, at least 35 wt. %, or at least 40 wt. %. For example, the flowable product can comprise milk or milk alternatives (e.g., whole cow's milk, 2% cow's milk, 1% cow's milk, skim or nonfat cow's milk, almond milk, soy milk, rice milk, coconut milk, goat's milk, buffalo's milk, etc.), cream (e.g., heavy whipping cream, whipping cream, medium cream, light cream, half and half, etc.), ice cream, mayonnaise, butter (including clarified butter and ghee), oil (e.g., vegetable oils), animal fats (e.g., tallow, lard, etc.) nut butter (e.g., peanut butter, almond butter, cashew butter, pecan butter, coconut butter, etc.), salad dressing, mashed potatoes, guacamole, etc. However, the skilled person will understand that the particular identity of the flowable product in the particular example is not limiting so long as there is sufficient fat content in the flowable product to allow it to foam in response to mechanical agitation. Preferably, the flowable product comprises milk or cream.

In another non-limiting example, the flowable product may be another product other than a product including a fat. This flowable product may be included in the aerosol can along with a substantially non-soluble propellant. The flowable product and propellant are in contact with one another within the container and may form a mixture. The shearing chamber is coupled to the can and is designed and constructed to shear the flowable product to foam the product within the chamber. The flowable product may be a non-Newtonian fluid or a Newtonian/quasi-Newtonian fluid. In one or more examples, the flowable product that is dispensed as a foam using the disclosed container assembly may be suitable for use as a personal care product, such as shaving cream, hair mouse, soap, shampoo, skin cleanser, lotion, sun block, tanner, dry shampoo, conditioners, among others. In such an example, the propellant may be used as a surfactant for the foamed product. In one or more examples, the flowable product that is dispensed as a foam using the disclosed container assembly may be suitable for use in the construction and similar industries, such as polyurethane foam, floor underlayment, carpet cushioning. The flowable product may be other products suitable for use as a foam, including foodstuff, plastics, and other materials.

Referring to the drawings, embodiments of a pressurized container assembly including pressurized container, a flowable product and a non-soluble propellant within the container, a valve coupled to the container, and a shearing chamber are shown and described. In each embodiment, the container may be constructed of any appropriate material, for example a metal (e.g., steel, tinplate, aluminum, stainless steel, etc.) or plastic (e.g., thermoplastic). The valve may be any suitable valve for selectively dispensing the flowable product from the container. The valve may be a tilt valve, push-down valve, spring valve, or any other suitable valve for dispensing a foamed, flowable product. The illustrated valves are non-limiting examples.

Figure 2:
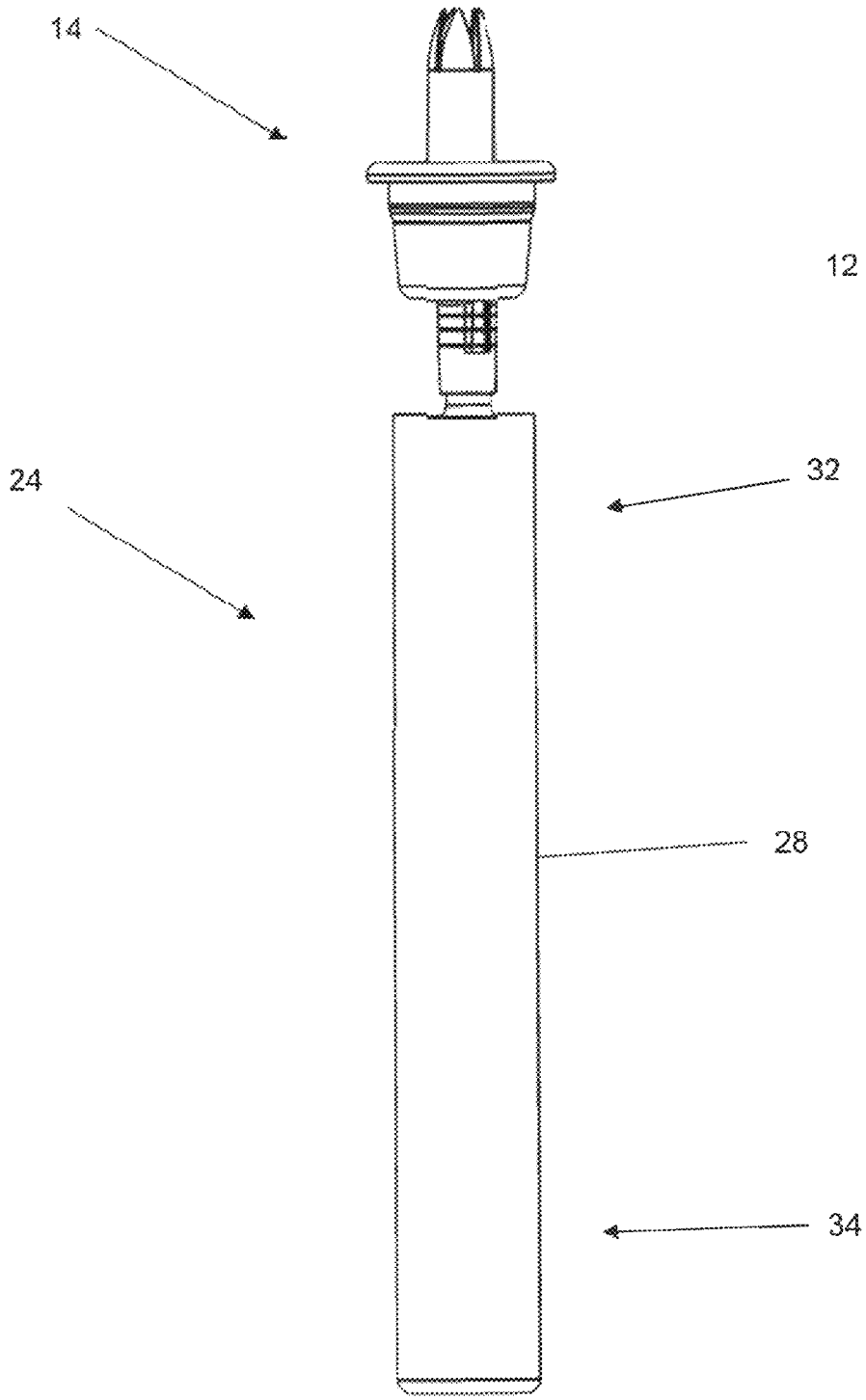
FIG. 2 is a front view of an embodiment of the shearing chamber with valve.

One embodiment of a pressurized container assembly is illustrated in FIG. 2. The assembly includes a pressurized container 12 and a valve 14. The container 12 may be a conventional container, and may be metal or plastic for example. Referring to FIG. 1, the illustrated valve 14 is a conventional tilt valve with mounting cup 48 and stem 50 but it will be understood by those skilled in the art that other types of valve suitable for attachment to a pressurized container (such as, for example, vertically actuated valves) can also be used in conjunction with the present disclosure. For example, the valve 14 can be a spring valve or a toggle valve. When used as a tilt valve, a force is applied to the side of the stem 50 to rotate or pivot the stem and unseat a disc situated at the lower end of the stem body from the seat portion (i.e., bottom portion) of the mounting cup 48, as is generally known in the art. When used as a vertically actuated valve, an axial force is applied to the stem 50 to unseat the disc from the seat portion of the mounting cup 48. The valve 14 can also comprise a seal 52 that interfaces between the mounting cup 48 and the stem 50. Seals can be made of any appropriate material, for example rubber of thermoplastic elastomers. It will be understood that any type of valve configuration and addition of valve components are acceptable so long as the flowable product is pushed through the shearing chamber 24 and out valve 14 through the release of pressure via valve 14.

In one particular embodiment, the valve 14 includes mounting cup 48, stem 50, and seal 52 (e.g., a grommet) disposed between and interconnecting the stem 50 and the mounting cup 48. The mounting cup 48 has a generally cylindrical sidewall, a generally flat bottom wall, and an upper curled lip at an upper end of the sidewall. A central portion extends upward from a central region of the bottom wall and defines a mounting opening through which the seal 52 and the stem 50 extend. The mounting cup 48 is received in an opening on the top of the container, and the mounting cup 48 is crimped (clinched) or otherwise attached to the container. The seal 42 is made of a resilient material and has an elongate neck which extends through the mounting opening. A seal bead extends radially outward from the neck and overlies and presses against an upper peripheral edge of the central portion to secure the seal 52 to the mounting cup 48. The stem 50 includes an elongate tubular stem body with an outlet and inlet(s) (orifices) at the upper and lower ends, respectively, and a disc (or button) at the lower end of the stem body. The stem body snugly fits through a bore defined by the seal 52 to form a seal therebetween. The disc seats against a seat portion of the seal 52 to form a leak proof seal when the valve 14 is in a non-actuated position. The disc is movable away from the seat portion in an actuated position to allow product in the container, via pressure inside the container, to flow between the disc and the seat portion and through inlet(s) of the stem 50. Depending on the actuator used to operate the valve, the valve may function as a vertically actuated valve, whereby axial force is applied to the stem 50 to unseat the disc from the seat portion of the seal 52, or alternatively, as a tilt valve, whereby a rotational force is applied to the side of the stem 50 to unseat the disk, as described above.

The container 12 contains the flowable product and propellant. The propellant is preferentially substantially non-soluble (i.e., insoluble) in the flowable product. For example, the concentration of propellant dissolved in flowable product will be less than about 15 wt. %, less than about 10 wt. %, less than about 5 wt. %, less than about 4 wt. %, less than about 3 wt. %, less than about 2 wt. %, less than about 1 wt. %, less than about 0.5 wt. %, less than about 0.3 wt. %, or less than about 0.1 wt. %. In order to achieve the desired level of non-solubility, the propellant is typically a non-polar gas. For example, the propellant can comprise a noble gas, a diatomic gas, a hydrocarbon gas, or a combination thereof. The propellant can comprise, as an example, helium gas, neon gas, argon gas, krypton gas, xenon gas, hydrogen gas, deuterium gas, nitrogen gas, oxygen gas, methane gas, acetylene gas, ethane gas, ethylene gas, propylene gas, propane gas, iso-butane gas, butane gas, 1-butene gas, 2-butene gas (cis or trans), tetrafluoromethane gas, sulfur hexafluoride gas, carbon dioxide gas, or a combination thereof. It will be understood by the skilled person that the viability of the propellant may vary with the identity of the flowable product. For example, if the flowable product is consumable food, not all propellants listed above may be appropriate. Alternatively, the propellant can comprise air, for example, compressed air. Preferably, the propellant comprises helium gas, neon gas, argon gas, krypton gas, xenon gas, nitrogen gas, air, or a combination thereof. More preferably, the propellant comprises nitrogen gas, air, or a combination thereof. For example, the propellant can comprise nitrogen gas, or the propellant can comprise air (e.g., compressed air).

The propellant pressurizes the container 12. The propellant is generally in the form of a liquid, although it will be understood that (a) a certain amount of the liquid may be in equilibrium with its gaseous form and (b) not all propellants described herein can be pressurized to a liquid (e.g., air). For example, compressed air will be present in its gaseous form. Once pressure is released by opening the valve 14, the propellant pushes the flowable product into the fluid inlet and a shearing chamber 24, described below. The shearing chamber 24 may be of any size and shape. The shearing chamber 24 can also be constructed of any appropriate material, such as, for example, a metal (e.g., steel, tinplate, aluminum, stainless steel, etc.) or a plastic (e.g., thermoplastic). The shearing chamber 24 can include any geometry therein to facilitate mechanical agitation of the flowable product as it passes through.

Figure 3:
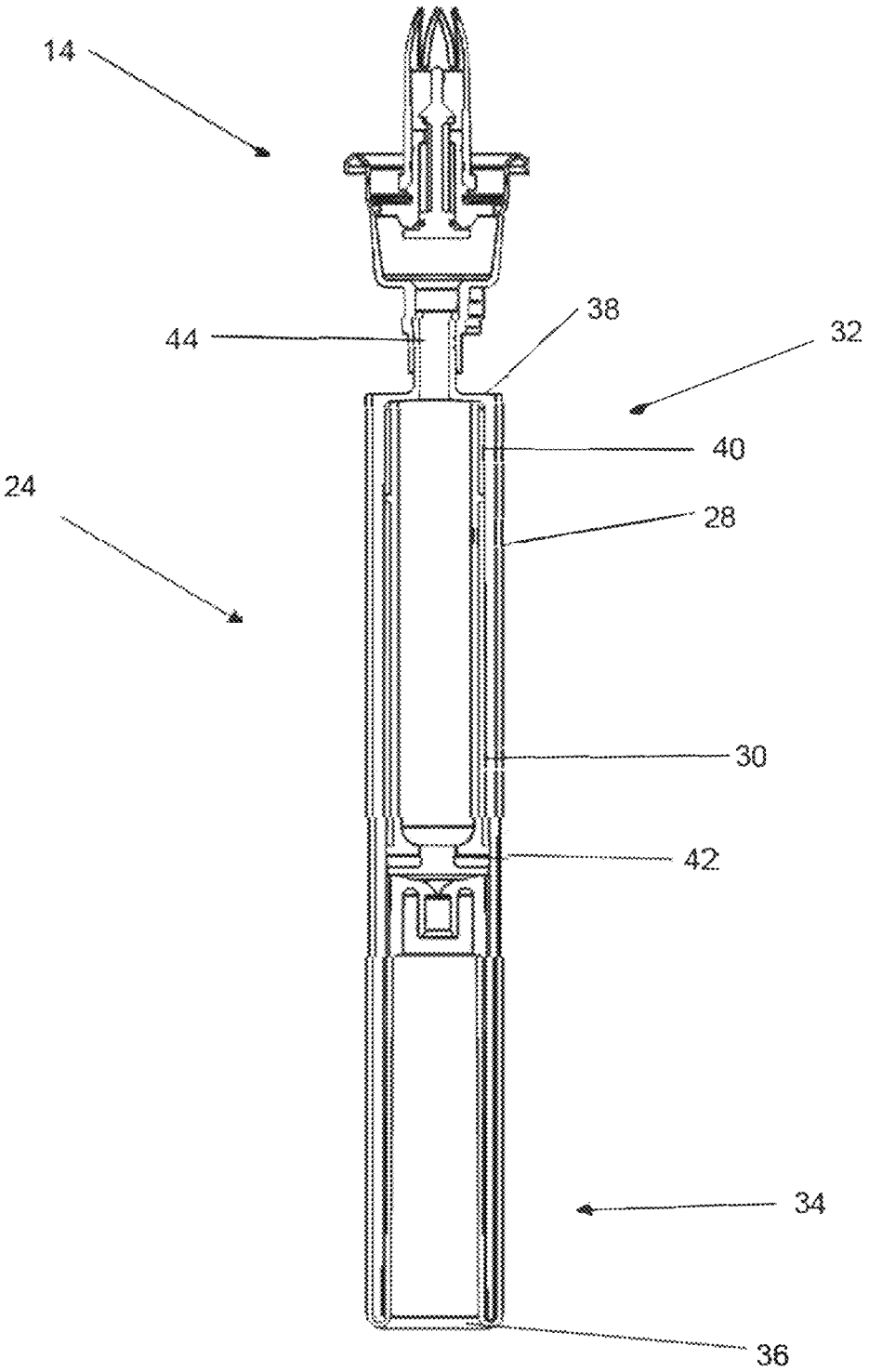
FIG. 3 is a cross section of the shearing chamber with valve of FIG. 2.

An exemplary shearing chamber 24 is depicted in FIGS. 2 and 3 in conjunction with valve 14. The shearing chamber 24 comprises an outer shell 28 and inner shell 30, each of which are generally cylindrical in shape, although the skilled person will understand that a variety of different shapes may be suitable. The inner shell 30 nests within outer shell 28.

The shearing chamber 24 has an upper portion 32 and a lower portion 34. The lower portion 34 defines gas port 36, which allows the propellant to flow into shearing chamber 24. The upper portion 32 of shearing chamber 24 defines a fluid inlet 38, which allows the flowable product to enter shearing chamber 24 in the space 40 (the boundary layer region) between outer shell 28 and inner shell 30. This causes the flowable product to experience a turbulent flow produced by the boundary layer effect as it travels through the boundary layer region. The flowable product then travels through inner shell opening 42 and into the inner shell 30. At this point, propellant that has entered through gas port 36 can also enter the inner shell 30 through inner shell opening 40 and commingle with the sheared flowable product. Introducing the propellant at this stage in the shearing process enhances the fluffiness of the flowable product before it exits the can. The sheared flowable product can then exit shearing chamber 24 through fluid outlet 44 in the upper portion 32 of shearing chamber 24 to the valve 14.

Figure 4:
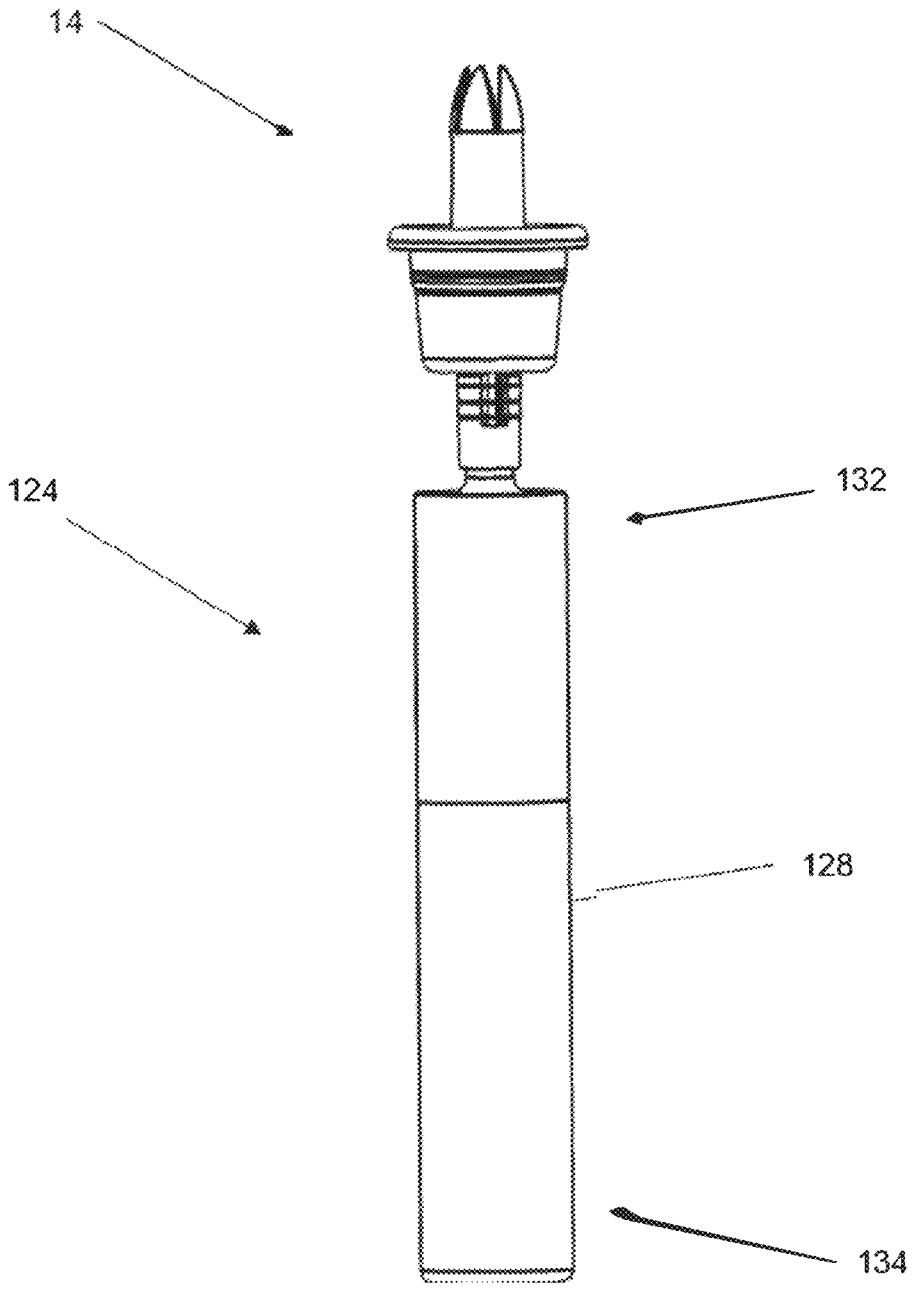
FIG. 4 is a front view of another embodiment of the shearing chamber with valve.
Figure 5:
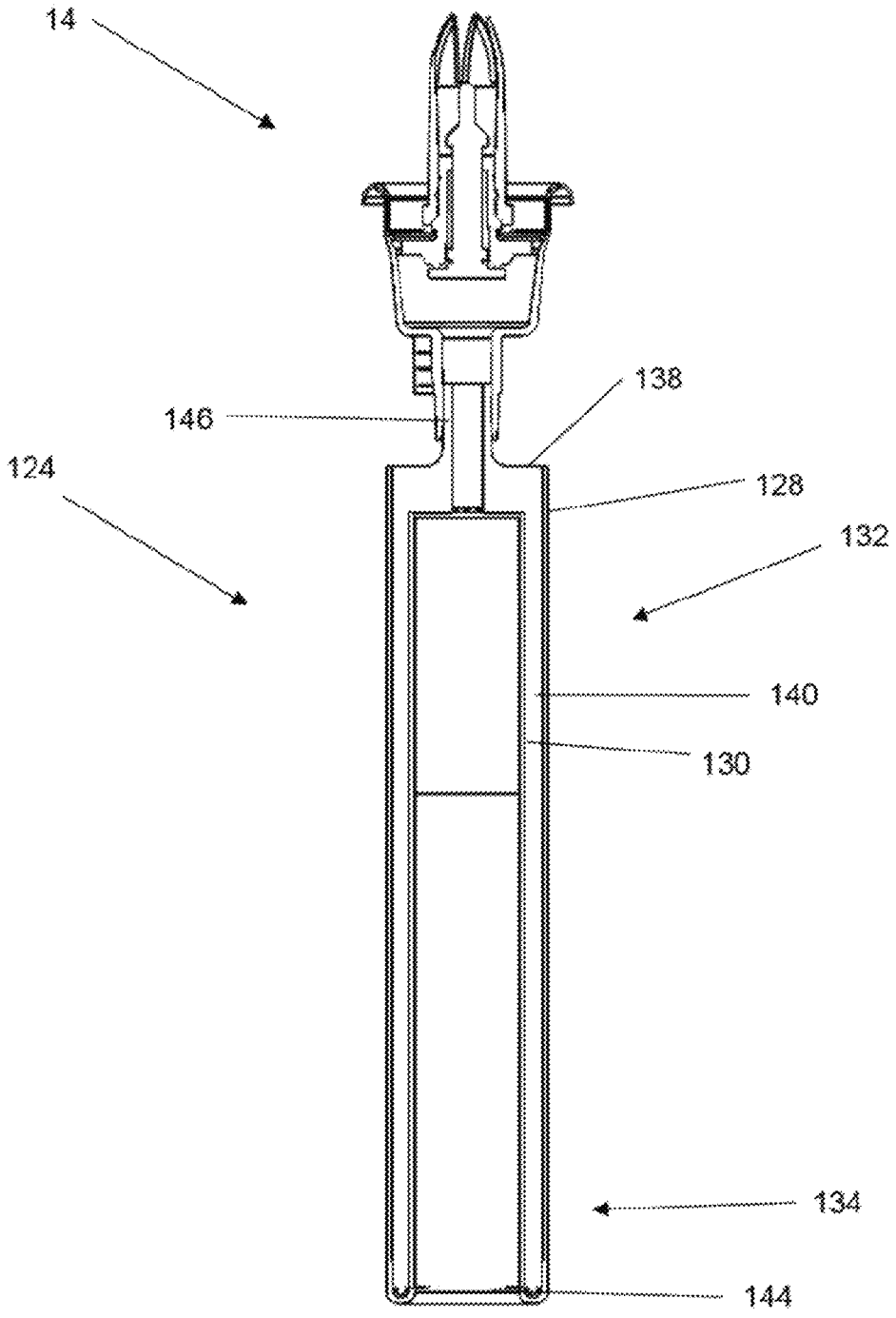
FIG. 5 is a cross section of the shearing chamber with valve of FIG. 4.

However, in some instances, propellant is not introduced into shearing chamber. Referring now to FIGS. 4 and 5, the shearing chamber 124 comprises an outer shell 128 and inner shell 130, each of which are generally cylindrical in shape, although the skilled person will understand that a variety of different shapes may be suitable. The inner shell 130 nests within outer shell 128.

The shearing chamber 124 has an upper portion 132 and lower portion 134. The upper portion 132 of shearing chamber 124 defines a fluid inlet 138, which allows the flowable product to enter shearing chamber 124 in the space 140 (the boundary layer region) between outer shell 128 and inner shell 130. As previously described, this causes the flowable product to experience a turbulent flow produced by the boundary layer effect as it travels through the boundary layer region. The lower portion 134 of inner shell 130 defines an inner shell opening 144, which allows the flowable product to enter the inner shell 130. The flowable product then travels through inner shell 130 to exit the shearing chamber 124 through fluid outlet 146 in the upper portion 132 of shearing chamber 124 to valve 14.

Figure 6:
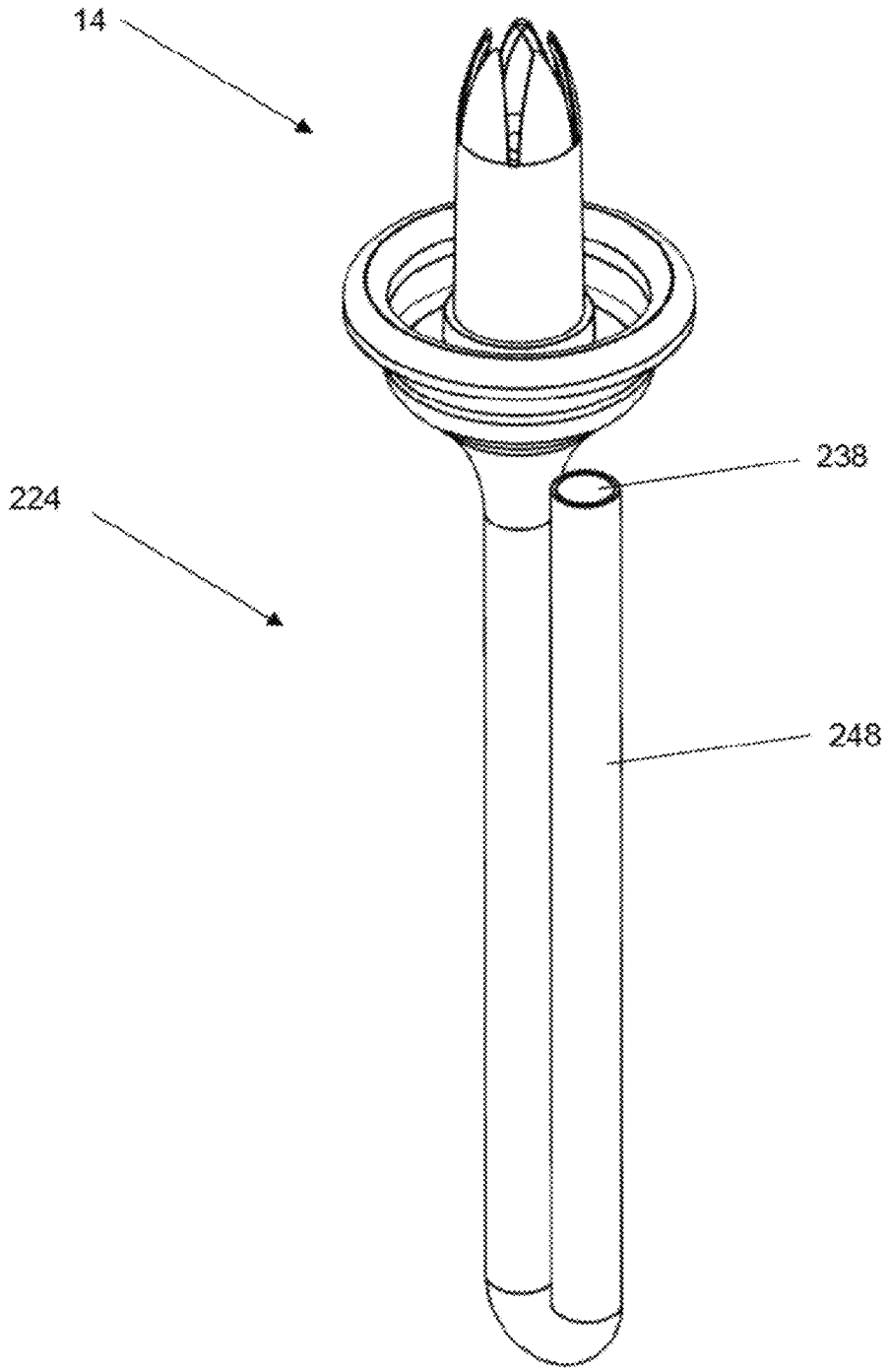
FIG. 6 is a perspective view of another embodiment of the shearing chamber with valve.
Figure 7:
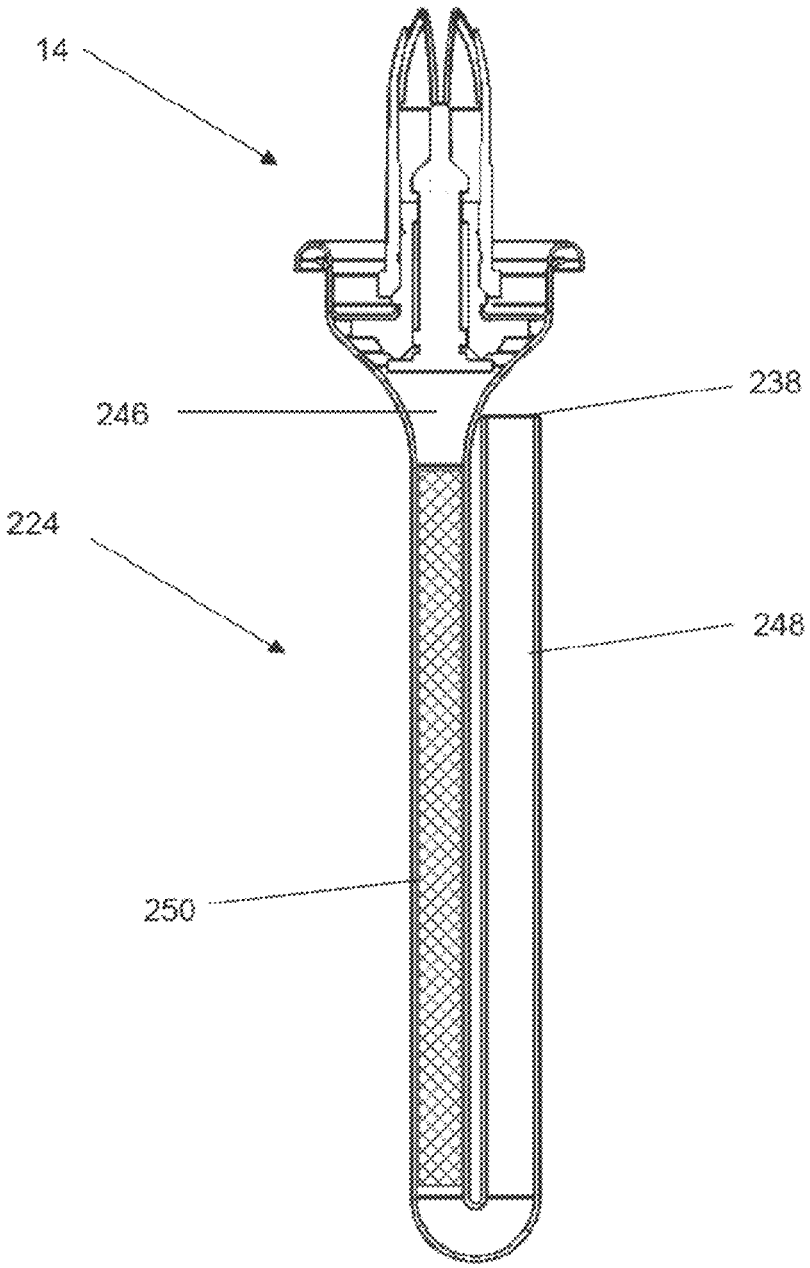
FIG. 7 is a cross section of the shearing chamber with valve of FIG. 6.

Referring now to FIGS. 6 and 7, in another embodiment suitable for use with a pressurized container to form a pressurized container assembly, flowable product enters a tube 248 through fluid inlet 238. Flowable product travels through the tube to shearing chamber 224. In this embodiment, instead of relying on parallel plates, turbulent flow is introduced through shearing media 250. Shearing media 250 can comprise, for example, glass or plastic beads, fibrous material, synthetic thread, molded/extruded geometries, and the like. For example, fibrous material can be used as shearing medium 250, and can be packed at different densities in order to adjust the flow rate of the flowable product. The packing density may also affect the amount of mechanical agitation and thereby the foam amount of the flowable product upon exiting the shearing chamber 224. The fibrous material can include synthetic fibers, steel wool, and the like, the length and diameter of which could be adjusted by the skilled person to achieve the desired properties in the foamed flowable product. The synthetic fibers can be, for example, a polymer of cellulose, nylon, polypropylene, or the like.

Alternatively, or in addition, the shearing medium 250 can comprise static mixing geometry, which generally refers to laminar or turbulent flow mixing without moving components and within a relatively short length. Mechanical agitation is accomplished through turbulence in the flow of the flowable product through the shearing chamber 224 as it hits different static mixing elements of different geometries within the shearing chamber 224. The static mixing elements can comprise any appropriate geometry, for example, baffles, helical elements, and the like, and can be constructed of any material, such as metal (e.g., aluminum) or plastic (e.g., thermoplastic polymer). The shearing elements can be in any particular order and in any particular number within the shearing chamber 224. Additional or different elements can also be used as appropriate to enhance the mechanical agitation of the flowable product. Once the flowable product travels through shearing media 250, it exits the shearing chamber 224 through fluid outlet 246 to valve 14. In one example, the container and system is free from a vapor trap, as shown.

Figure 8:
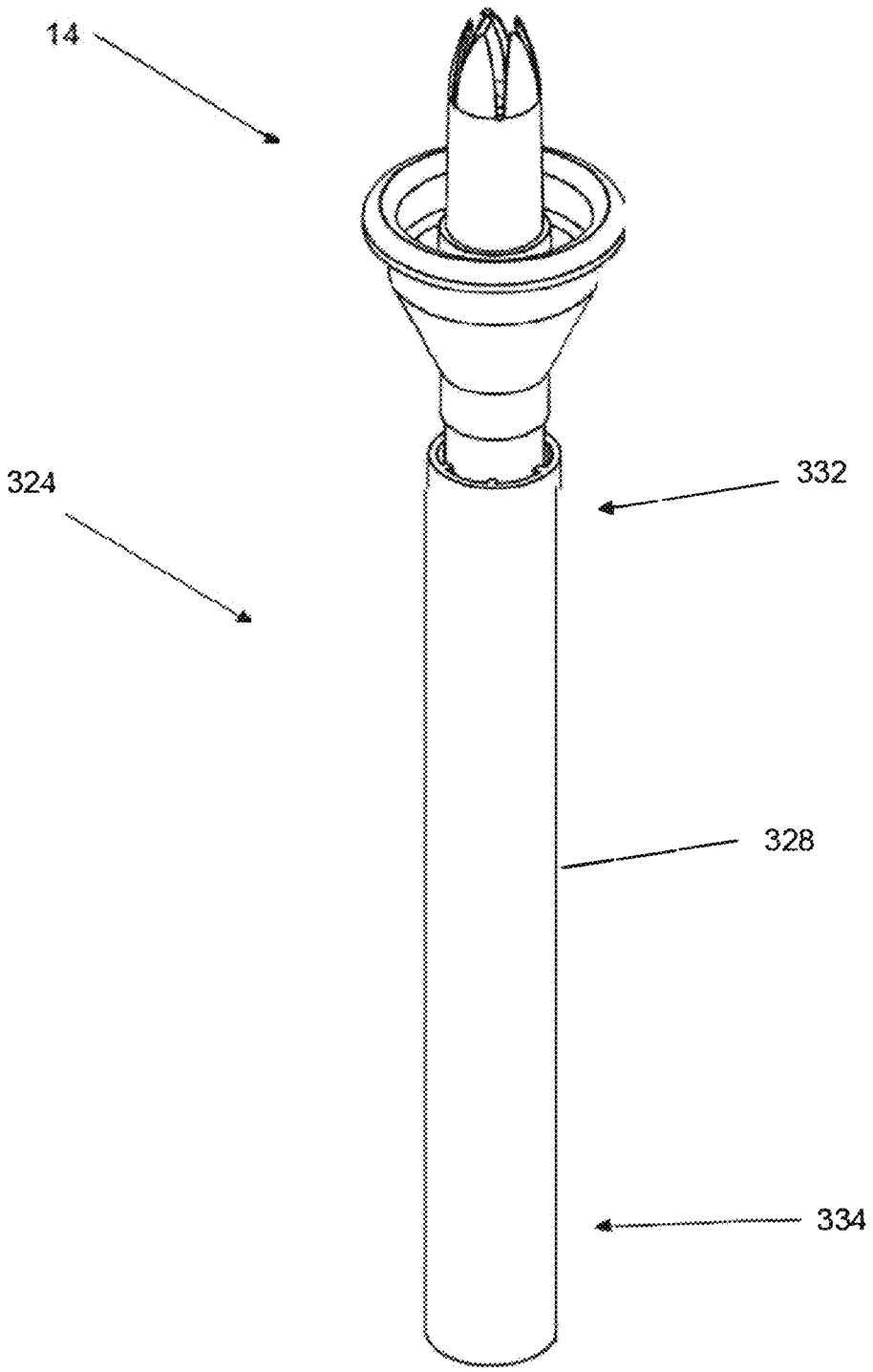
FIG. 8 is a perspective view of another embodiment of the shearing chamber with valve.
Figure 9:
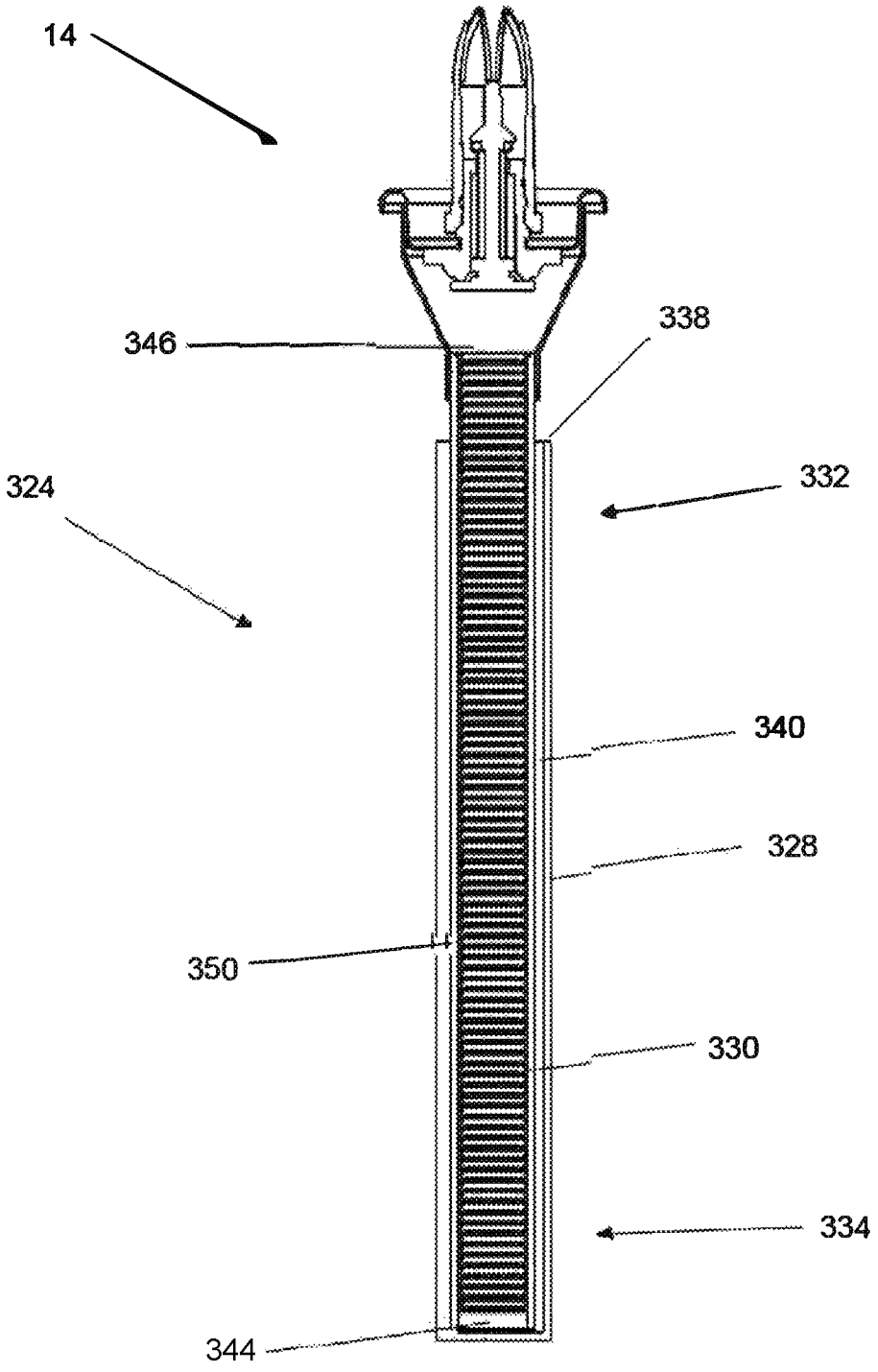
FIG. 9 is a cross section of the shearing chamber with valve of FIG. 8.

Referring now to FIGS. 8 and 9, both the boundary layer effect and shearing media can be used with a pressurized container. In this variation, the shearing chamber 324 comprises an outer shell 328 and inner shell 330, each of which are generally cylindrical in shape, although the skilled person will understand that a variety of different shapes may be suitable. The inner shell 330 nests within outer shell 328.

The shearing chamber 324 has an upper portion 332 and lower portion 334. The upper portion 332 of shearing chamber 324 defines a fluid inlet 338, which allows the flowable product to enter shearing chamber 324 in the space 340 (the boundary layer region) between outer shell 328 and inner shell 330. As previously described, this causes the flowable product to experience a turbulent flow produced by the boundary layer effect as it travels through the boundary layer region. The bottom portion 342 of inner shell 330 defines an inner shell opening 344, which allows the flowable product to enter the inner shell 330. Inner shell 330 confines shearing media 350, which has the same characteristics and possible configurations as shearing media 250 described above. In the illustrated embodiment, shearing medium 350 comprises numerous plates having elongated openings. In order to increase turbulent flow, the elongated openings can be rotated, for example rotated about 90 degrees, between adjacent plates. Once the flowable product travels through inner shell 330 and shearing media 350, it exits the shearing chamber 324 through fluid outlet 346 in the upper portion 332 of shearing chamber 324 to valve 14.

Figure 10:
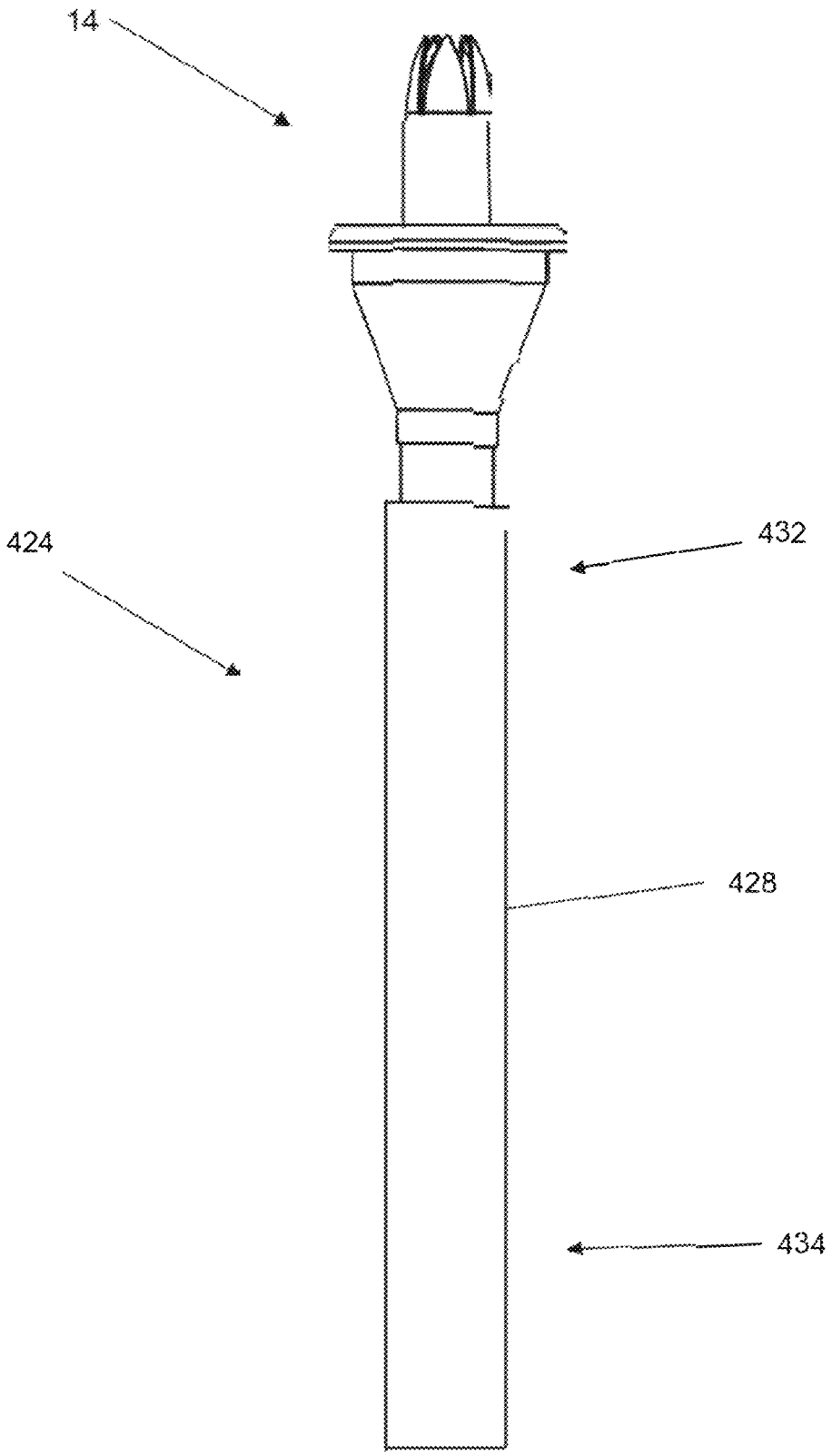
FIG. 10 is a front view of another embodiment of the shearing chamber with valve.
Figure 11:
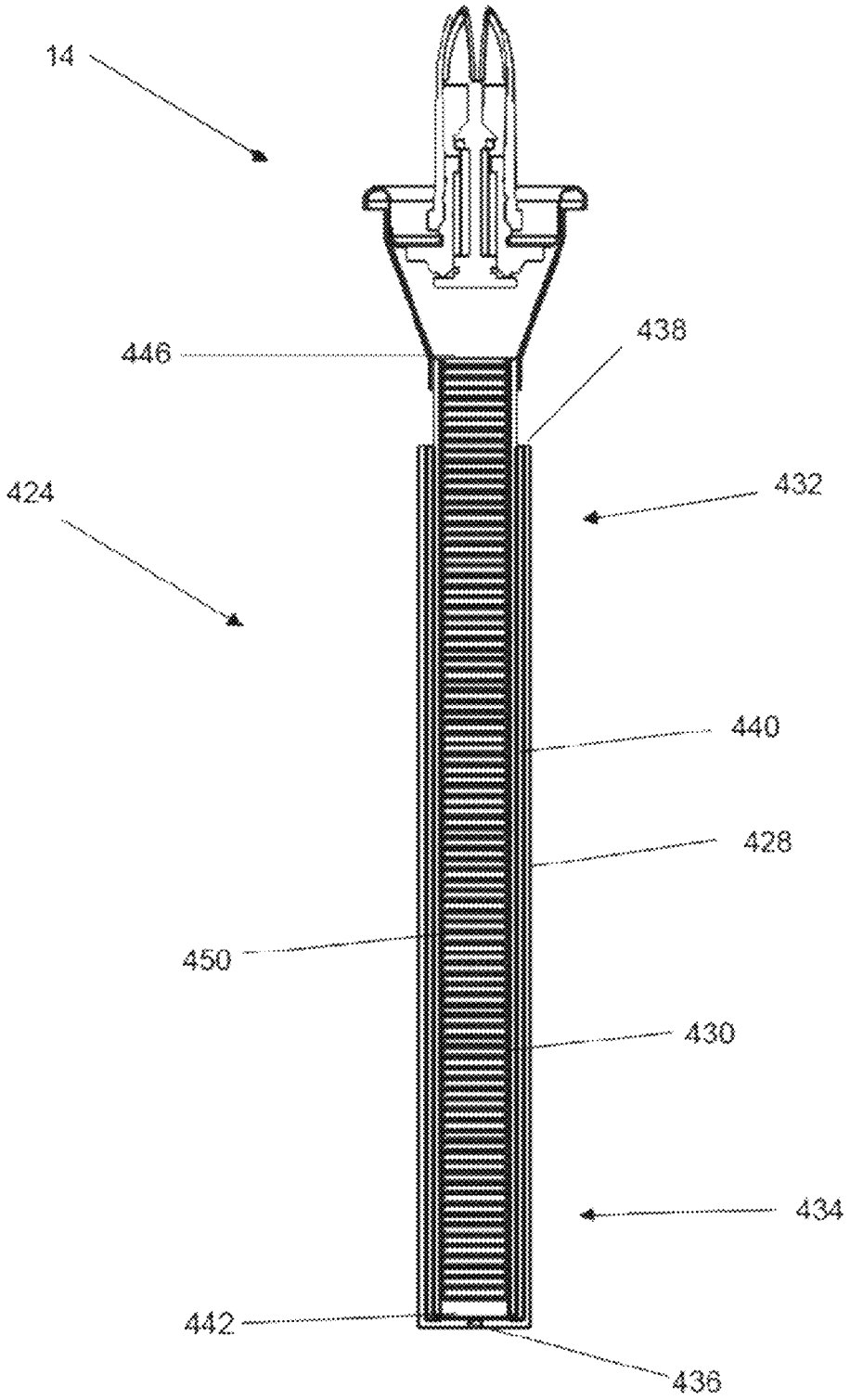
FIG. 11 is a cross section of the shearing chamber with valve of FIG. 10.

Referring now to FIGS. 10 and 11, in an alternative embodiment, the shearing chamber 424 comprises an outer shell 428 and inner shell 430, each of which are generally cylindrical in shape, although the skilled person will understand that a variety of different shapes may be suitable. The inner shell 430 nests within outer shell 428.

The shearing chamber 424 has an upper portion 432 and a lower portion 434. The lower portion 434 defines gas port 436, which allows the propellant to flow into shearing chamber 424. The upper portion 432 of shearing chamber 424 defines a fluid inlet 438, which allows the flowable product to enter shearing chamber 424 in the space 440 (the boundary layer region) between outer shell 428 and inner shell 430. This causes the flowable product to experience a turbulent flow produced by the boundary layer effect as it travels through the boundary layer region. The flowable product then travels through inner shell opening 442 and into the inner shell 430. At this point, propellant that has entered through gas port 436 can also enter the inner shell 430 through inner shell opening 440 and commingle with the sheared flowable product. Introducing the propellant at this stage in the shearing process enhances the fluffiness of the flowable product before it exits the can. Inner shell 430 confines shearing media 450, which has the same characteristics and possible configurations as shearing media 250 described above. In the illustrated embodiment, shearing medium 450 comprises numerous plates having elongated openings. In order to increase turbulent flow, the elongated openings can be rotated, for example rotated about 90 degrees, between adjacent plates. Once the flowable product travels through inner shell 430 and shearing media 450, it exits the shearing chamber 424 through fluid outlet 446 in the upper portion 432 of shearing chamber 424 to valve 14.

Figure 12:
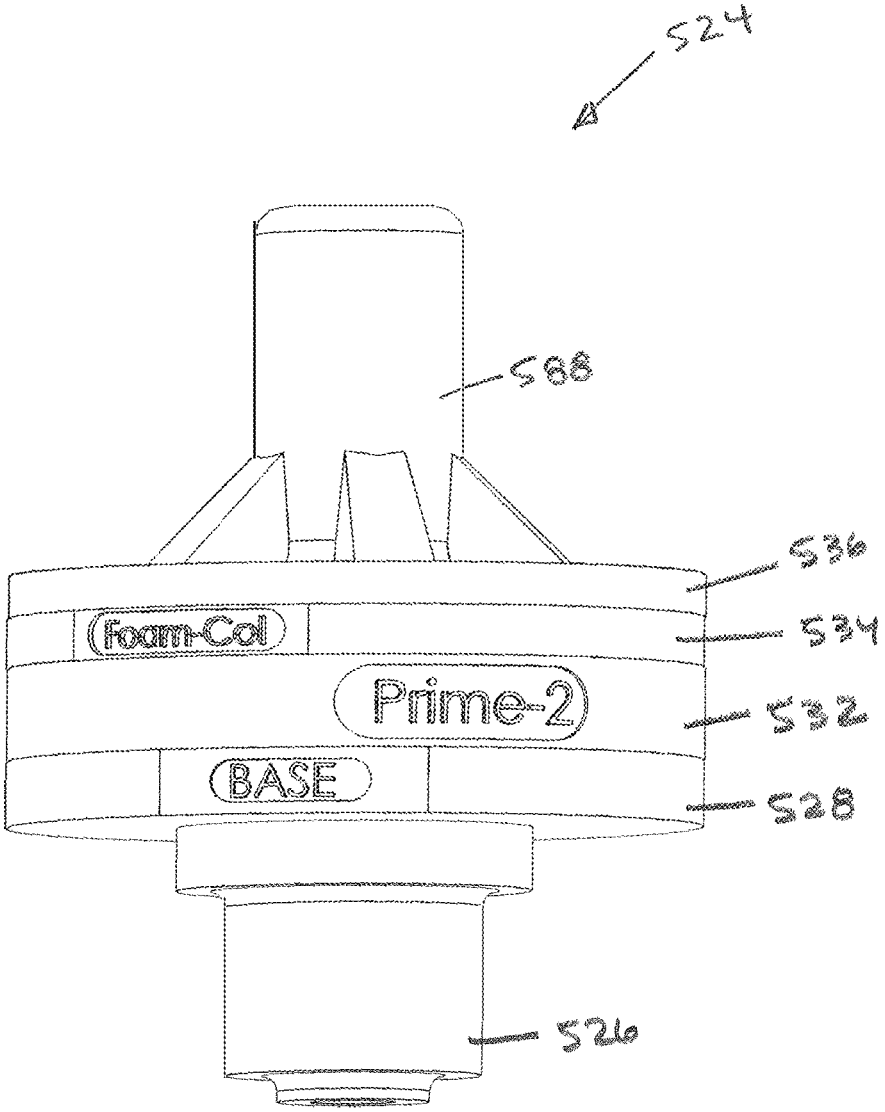
FIG. 12 is a perspective of another embodiment of a shearing chamber.
Figure 13:
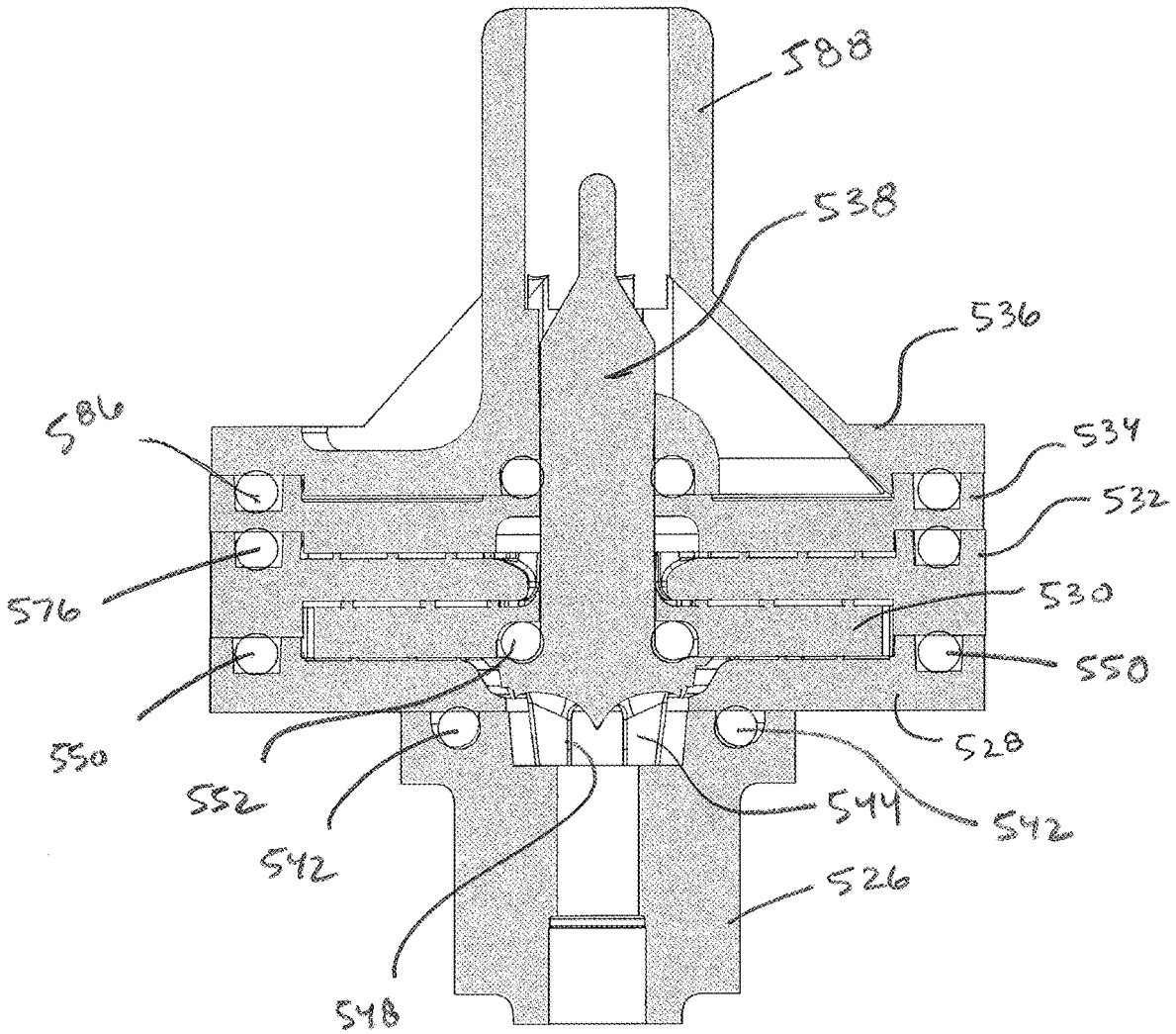
FIG. 13 is a cross section of the shearing chamber.

Referring to FIGS. 12 and 13, another embodiment of a shearing chamber is generally indicated at reference numeral 524. In this embodiment, the shearing chamber 524 comprises a lower section, which may be a spray valve adaptor 526 which can attach to the valve external to the can (e.g., the shearing chamber may be coupled to the stem 50 of the valve outside the can). For example, the shearing chamber 524 may be configured to be an actuator of the valve outside the can. In another example, the shearing chamber 524 may be intermediate the valve and the actuator, still outside the can. In these examples, the shearing chamber 524 is downstream of the valve so that the fluid is foamed after exiting the can. It is also envisioned that the shearing chamber 524 may be upstream of the valve, such as inside the can, so that the fluid is foamed before exiting the can (e.g., before the valve). In such as case, the lower section may not be an adaptor but rather the fluid may enter directly through the lower section or the lower section may be configured to attach to a tube or other conduit in the can for delivering fluid to the shearing chamber. It is also envisioned that the lower section may be omitted in some embodiments.

The shearing chamber 524 further includes stacked annular discs, which as explained in more detail below provide shearing to the fluid as it flows through the shearing chamber to foam the fluid using the same principles as described above herein. Of the stacked annular discs, there is a base annular disc 528 attached to the lower section, an interior primary-foaming annular disc 530 overlying the base annular disc, an exterior primary-foaming annular disc 532 overlying the interior primary-foaming annular disc 530, a foam-collecting annular disc 534 overlying the exterior primary-foaming annular disc 532, a foam-outer annular disc 536 overlying the a foam-collecting annular disc 534, and a stem 538 extending upward through the aligned central openings of the annular discs.

Figure 14:
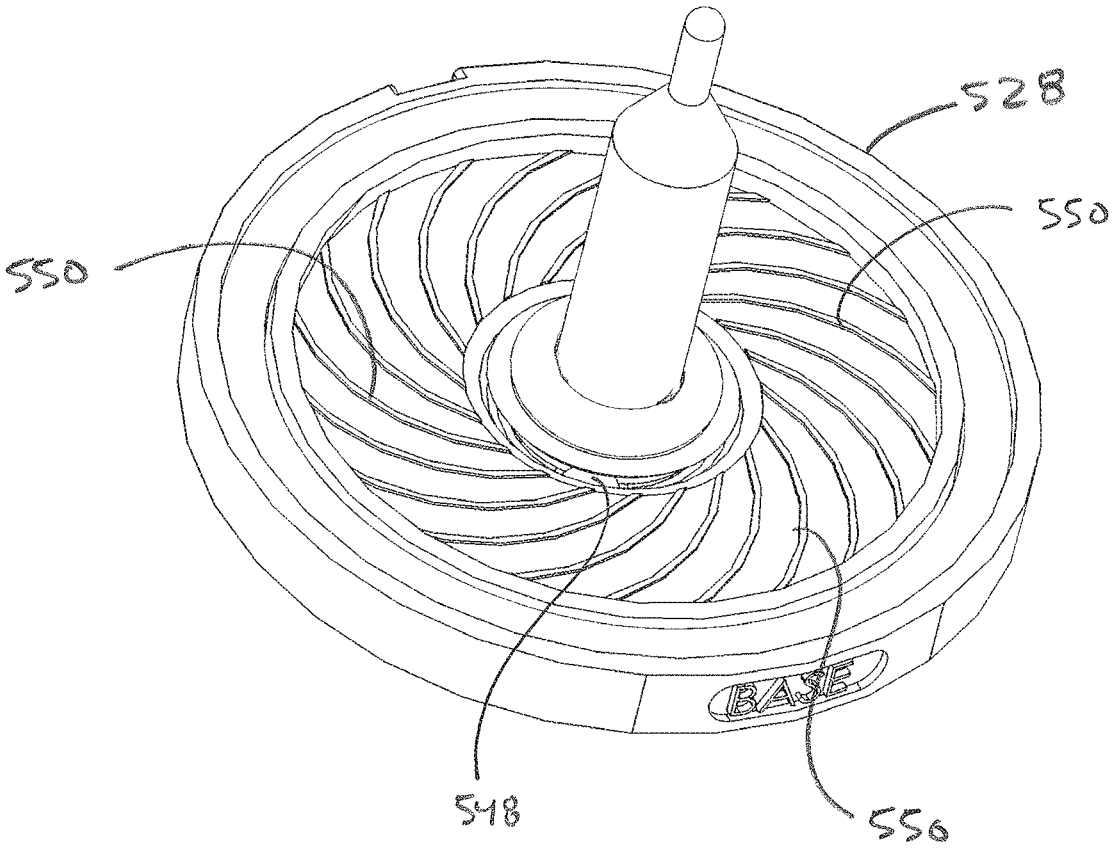
FIGS. 14-20 are various perspectives and exploded views of components of the shearing chamber.
Figure 15:
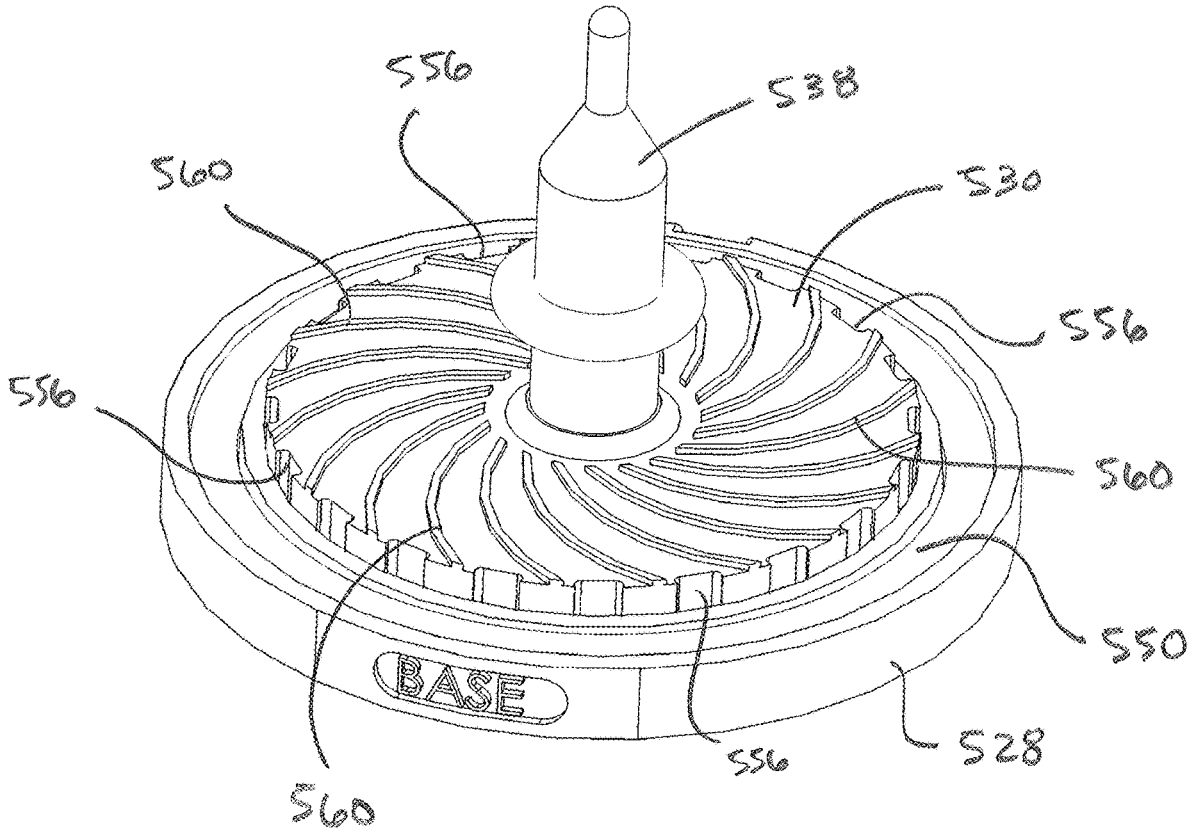

Referring to FIGS. 14 and 15, an annular gasket (O-ring) 542 seals the adapter 526 to the underside of the base annular disc 528. Other ways of sealing, other than the annular gasket 542 and the other gaskets described below, may be employed. For example, welding (e.g., sonic or spin welding) and/or glue or adhesive and/or force-fit may be used. A lower skirt 544 of the stem 538 is received in the central opening of the base annular disc. The skirt 544 defines radial openings 548 in communication with a fluid passage in the adaptor 526 for delivering the fluid through the central opening of the base annular disc 528 and onto the upper surface of the base annular disc. As shown in FIG. 14, ribs 550 (e.g., spiraled ribs) on the upper surface of the base annular disc 528 extend generally radially outward from the central opening toward the outer perimeter of the disc. These ribs 550 engage a lower surface of the interior primary-foaming annular disc 530 to define a plurality of radially-extending first fluid shearing conduits. The distance between the upper surface of the base annular disc 528 and the lower surface of the interior primary-foaming annular disc 530 (i.e., the height of the fluid shearing conduits) are such that the impart shearing to the flowing fluid like parallel plate fluid flow. An annular gasket (O-ring) 550 seals an outer, circumferential flange of the base annular disc to an outer, circumferential flange of the exterior primary-foaming annular disc 532. Also, an annular gasket (O-ring) 552 seals the stem 538 and the central opening of the interior primary-foaming annular disc 530.

Figure 16:
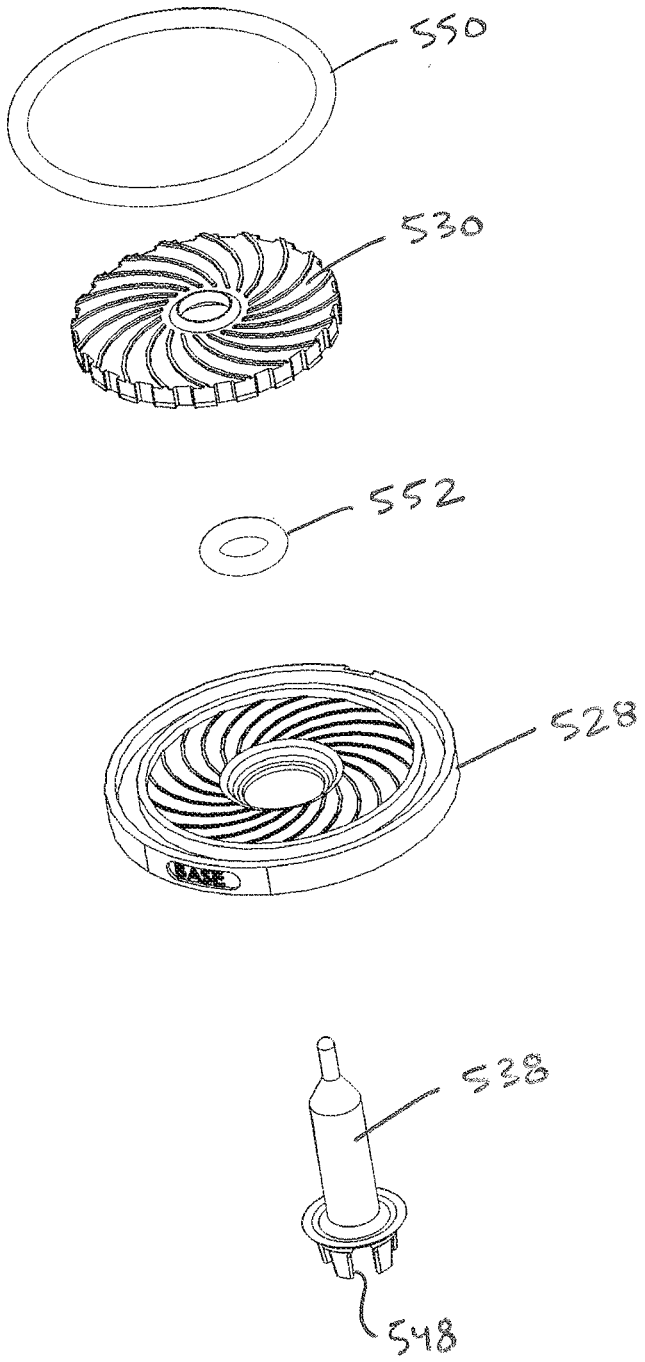

Referring to FIGS. 15 and 16, the fluid flowing within the first fluid shearing conduits is directed to the outer perimeter of the interior primary-foaming annular disc 530 wherein a plurality of slots 556 are defined to allow the fluid to flow upward onto the upper surface of the interior primary-foaming annular disc. In one example, the perimeter of the interior primary-foaming annular disc 530 is toothed to define the slot openings. As shown in FIG. 15, ribs 560 (e.g., spiraled ribs) on interior primary-foaming annular disc 530 extend generally radially outward from the central opening toward the outer perimeter of the disc. These ribs 560 engage a lower surface of the exterior primary-foaming annular disc 532 to define a plurality of radially-extending second fluid shearing conduits. The distance between the upper surface of the interior primary-foaming annular disc 530 and the lower surface of the exterior primary-foaming annular disc 532 (i.e., the height of the fluid shearing conduits) are such that they impart shearing to the flowing fluid like parallel plate fluid flow.

Figure 17:
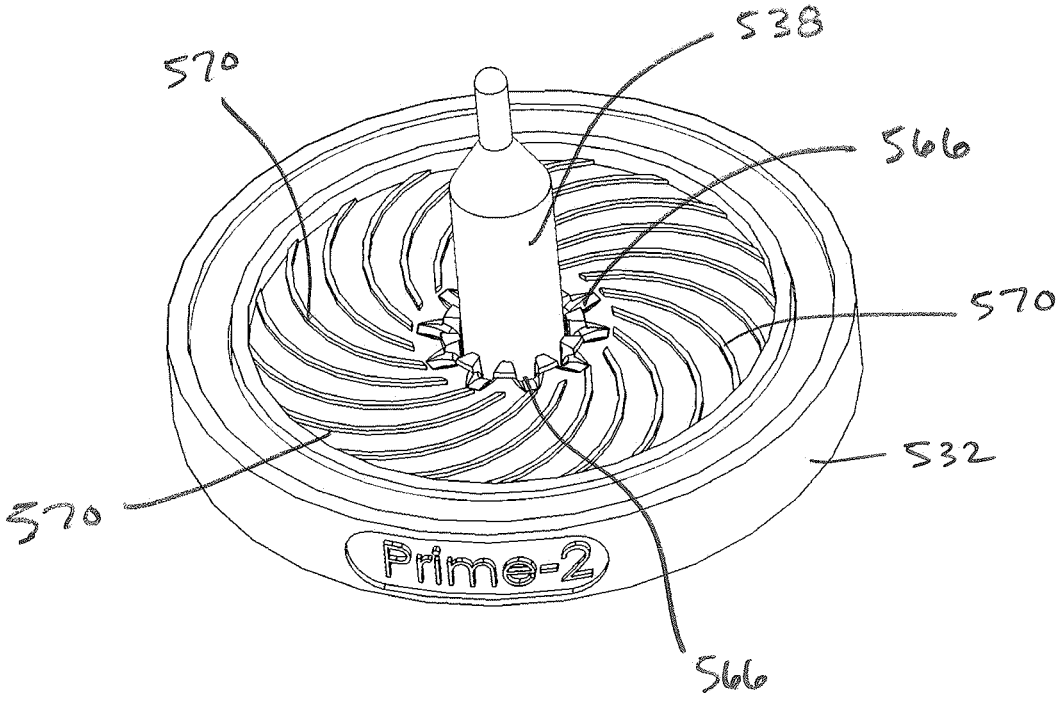
Figure 18:
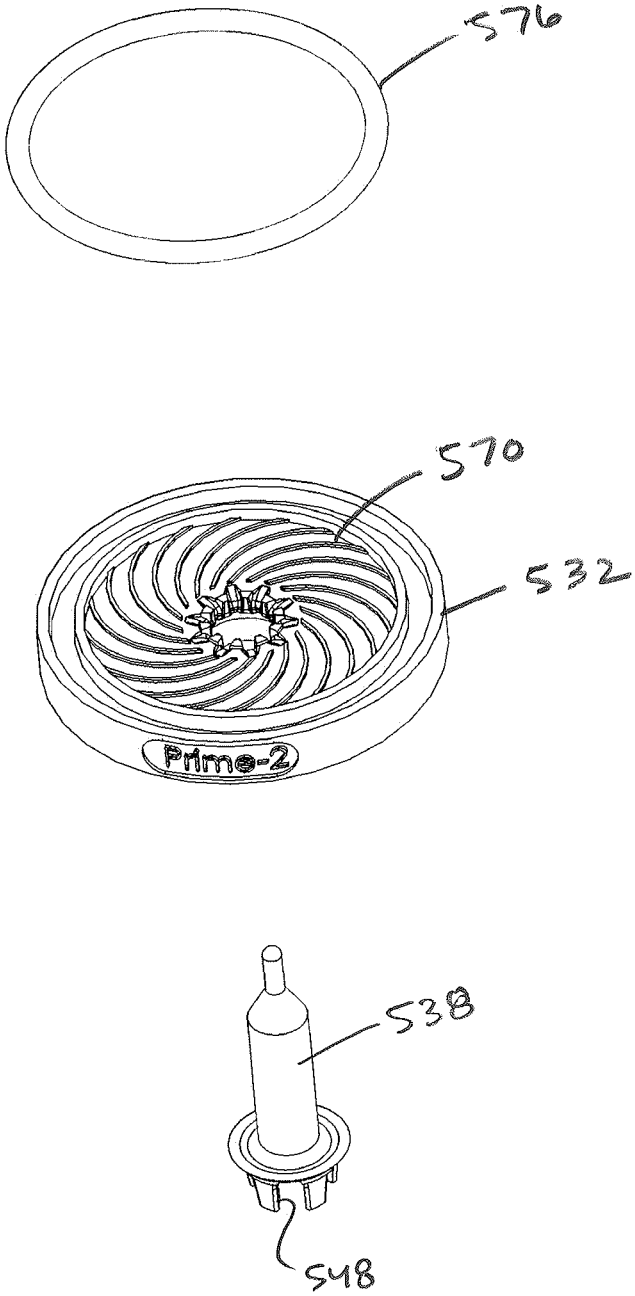

Referring to FIGS. 15 and 17, the fluid flowing within the second fluid shearing conduits is directed inward toward the central opening of the exterior primary-foaming annular disc 532 wherein a plurality of slots 566 are defined to allow the fluid to flow upward onto the upper surface of the exterior primary-foaming annular disc 532. In one example, the perimeter of the exterior primary-foaming annular disc 530 defining the central opening is toothed to define the slot openings. As shown in FIG. 17, ribs 570 (e.g., spiraled ribs) on the exterior primary-foaming annular disc 530 extend generally radially outward from the central opening toward the outer perimeter of the disc. These ribs 570 engage a lower surface of the foam-collecting annular disc 534 to define a plurality of radially-extending third fluid shearing conduits. The distance between the upper surface of the exterior primary-foaming annular disc 532 and the lower surface of the foam-collecting annular disc 534 (i.e., the height of the fluid shearing conduits) are such that they impart shearing to the flowing fluid like parallel plate fluid flow. An annular gasket (O-ring) 576 seals an outer, circumferential flange of the exterior primary-foaming annular disc 532 to an outer, circumferential flange of the foam-collecting annular disc 534.

Figure 19:
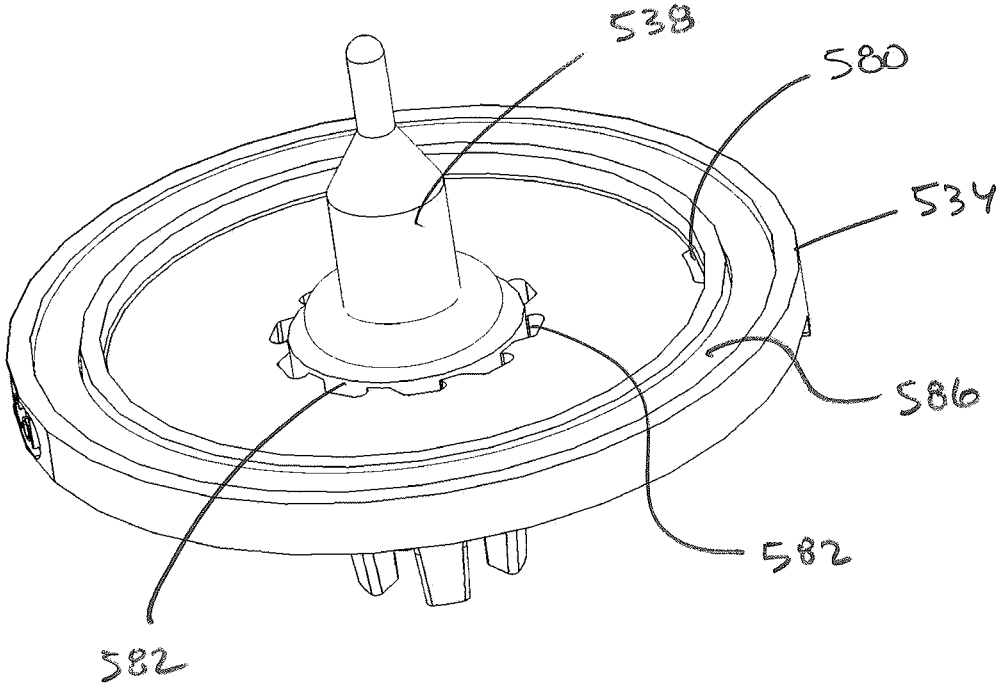
Figure 20:
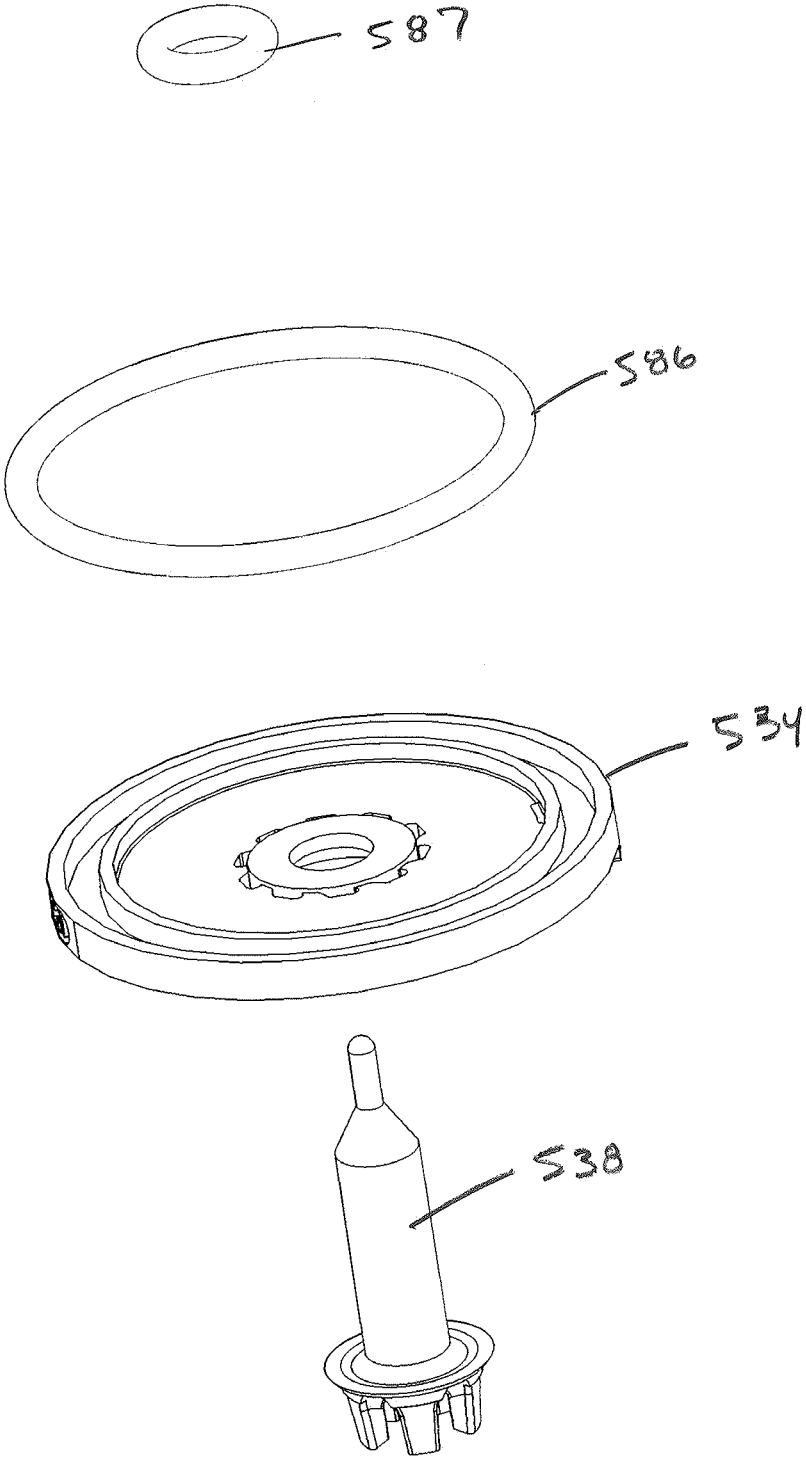

Referring to FIGS. 19 and 20, an upper surface of the foam-colleting annular disc 534 receives foamed fluid from the third shearing conduits. This foamed fluid may enter through one or more openings 580 adjacent a perimeter of the foam-collecting annular disc 534 and/or through a plurality of slots 582 at the central opening of the disc. The outlet disc 536 has a chamber which together with the upper surface of the foam-collecting annular disc 534 may hold foamed fluid. A gasket 586 (O-ring) seals an outer annular flange of the foam-collecting disc 534 to an outer flange of the outer disc 536. A gasket 587 seals the stem 538 and the outlet disc 536. The outlet disc 536 further includes an outlet (e.g., a nozzle) for delivering the foamed fluid.

In use, the pressurized product and inert gas are directed into the orifice at the bottom of the shearing chamber 10 and are successively sheared into a loose (different bubble sizes) foam in the primary shear section and then the derived foam is subjected to further foam conditioning in that the sizes of the bubbles within the foam are reduced (e.g., fractured) to produce a foam having smaller bubbles. The reduction is bubble size takes place in one or more foam conditioning sections. This reduction in bubble size in one or more foam conditioning zones may be imparted mechanically, such as by a boundary layer defined by the foam conditioning section and/or media (e.g., glass or plastic beads, fibrous material, synthetic thread, molded/extruded geometries, and the like, such as described above) disposed in the foam conditioning section. Tabs on the discs may be inserted into slots of adjacent discs to inhibit rotation of the discs relative to one another.

Figure 21:
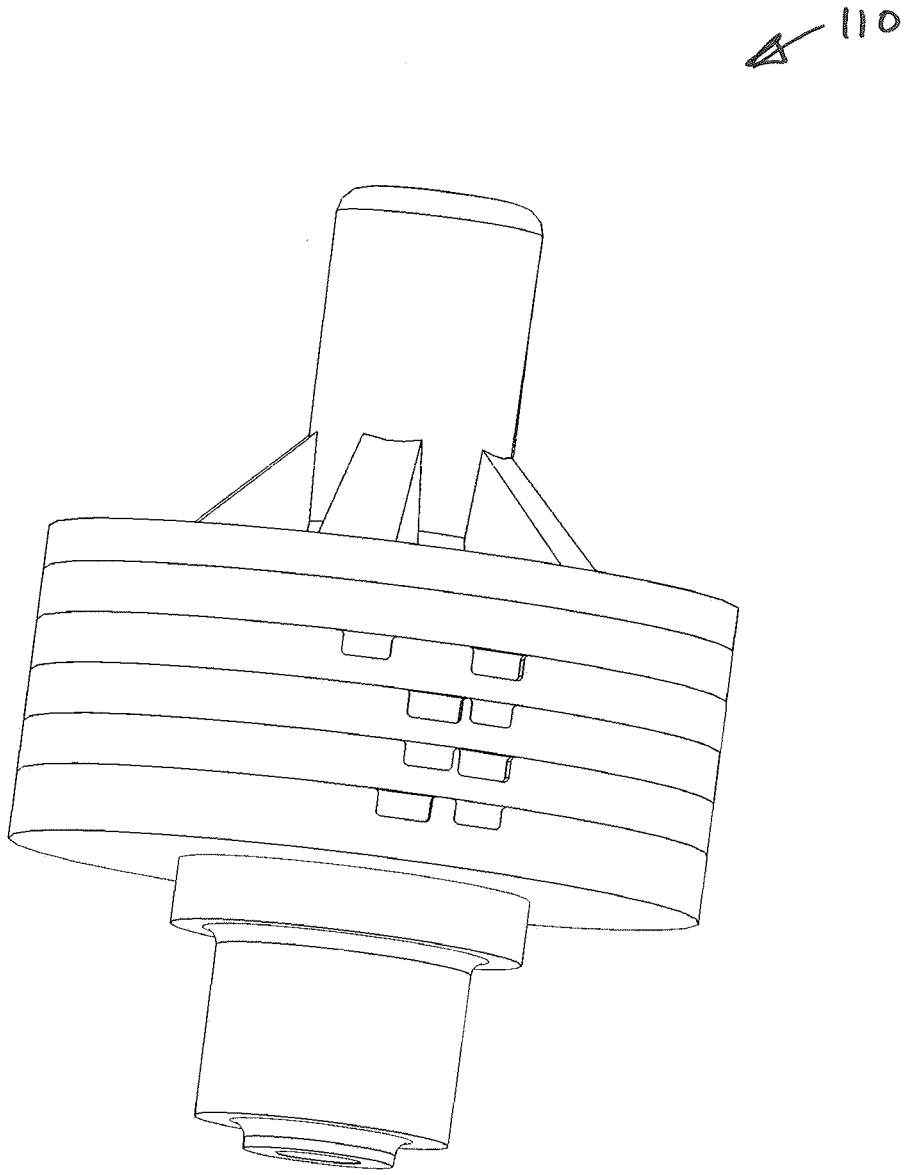
FIG. 21 is a perspective of another embodiment of the shearing chamber.
Figure 22:
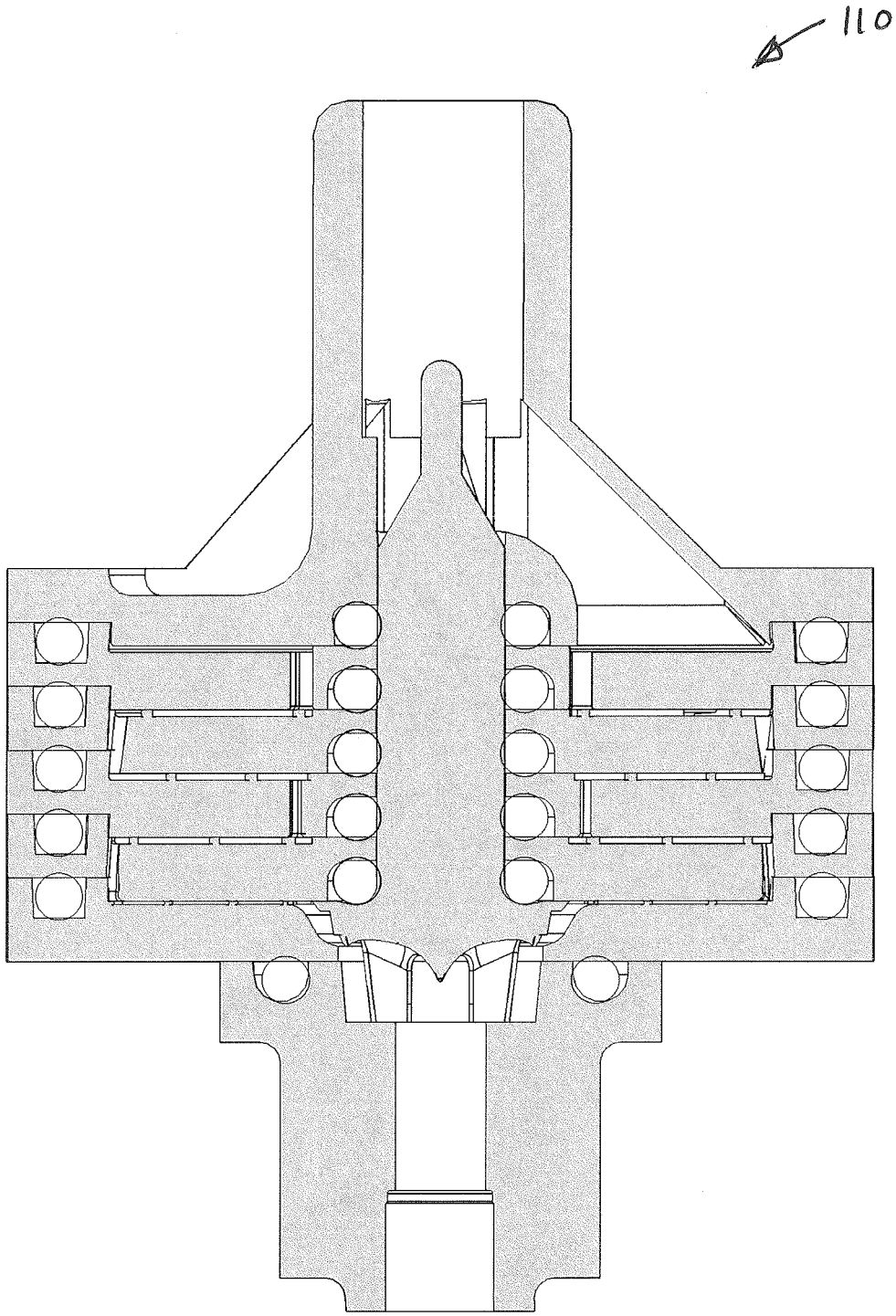
FIG. 22 is a cross section of the shearing chamber.

The shearing chamber 10 is modular in that additional shearing sections may be added to product further shearing by stacking additional exterior and interior annular shearing discs. Such an example is shown in FIGS. 21 and 22 at reference numeral 110.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products and methods without departing from the scope of the invention, it is intended that all matter contained in the above description and shown in the accompanying drawings shall be interpreted as illustrative and not in a limiting sense.

The invention claimed is:

1. An assembly for foaming and dispensing a flowable product from a container, the assembly comprising:

a valve configured to be coupled to the container; and a shearing chamber coupled to and in fluid communication with the valve, wherein the shearing chamber is configured to be received in the container and to receive a flow of the flowable product when the valve is actuated, wherein the shearing chamber includes an outer shell and an inner shell nested inside of the outer shell to define parallel surfaces defining a boundary layer configured to impart shear to the flowable product as the flowable product flows through the shearing chamber to foam the flowable product within the shearing chamber.

2. The assembly set forth in claim 1, wherein the shearing chamber has an inlet, through which the flowable product enters the shearing chamber, and an outlet, through which the flowable product after foaming exits the shearing chamber.

3. The assembly set forth in claim 2, wherein the inlet of the shearing chamber is at an upper end portion of the shearing chamber.

4. The assembly set forth in claim 3, wherein the valve includes an inlet that is downstream of the outlet of the shearing chamber.

5. The assembly set forth in claim 4, wherein the shearing chamber is coupled directly to the valve.

6. The assembly set forth in claim 1, in combination with the container, wherein the valve is coupled to the container, wherein the shearing chamber is received in the container.

7. The assembly set forth in claim 6, wherein the container is pressurized and contains flowable product and a propellant.

8. The assembly set forth in claim 7, wherein the propellant is substantially non-soluble in the flowable product within the container.

9. The assembly set forth in claim 7, wherein the flowable product is edible.

10. The assembly set forth in claim 9, wherein the flowable product has a fat content of at least 10 wt. % based on the total weight of the flowable product.

11. The assembly set forth in claim 7, wherein the propellant comprises a non-polar gas.

12. A container assembly comprising:

a container;

a flowable product and a propellant disposed within the container under pressure;

a valve coupled to the container, wherein the valve is configured to be selectively actuated; and a shearing chamber coupled to and in fluid communication with the valve, wherein the shearing chamber is in the container and is configured to receive a flow of the flowable product when the valve is actuated, wherein the shearing chamber includes an outer shell and an inner shell nested inside of the outer shell to define parallel surfaces defining a boundary layer configured to impart shear to the flowable product as the flowable product flows through the shearing chamber to foam the flowable product within the shearing chamber.

13. The container assembly set forth in claim 12, wherein the shearing chamber has an inlet, through which the flowable product enters the shearing chamber, and an outlet, through which the flowable product after foaming exits the shearing chamber.

14. The assembly set forth in claim 13, wherein the inlet of the shearing chamber is at an upper end portion of the shearing chamber.

15. The assembly set forth in claim 13, wherein the valve includes an inlet that is downstream of the outlet of the shearing chamber and configured to receive the flowable product after foaming.

16. The assembly set forth in claim 12, wherein the shearing chamber is coupled directly to the valve.

* * * * *